US010723575B2

(12) United States Patent
Chiba et al.

(10) Patent No.: US 10,723,575 B2
(45) Date of Patent: Jul. 28, 2020

(54) SEPARATION ROLLER, SHEET FEEDING APPARATUS, AND IMAGE FORMING APPARATUS

(71) Applicant: CANON KABUSHIKI KAISHA, Tokyo (JP)

(72) Inventors: Yoshinao Chiba, Kashiwa (JP); Wataru Murata, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/270,770

(22) Filed: Feb. 8, 2019

(65) Prior Publication Data

US 2019/0270603 A1 Sep. 5, 2019

(30) Foreign Application Priority Data

Mar. 1, 2018 (JP) ..... 2018-036884

(51) Int. Cl.
*B65H 3/52* (2006.01)
*B65H 3/06* (2006.01)
*B65H 1/08* (2006.01)

(52) U.S. Cl.
CPC ..... *B65H 3/0638* (2013.01); *B65H 1/08* (2013.01); *B65H 3/0676* (2013.01);
(Continued)

(58) Field of Classification Search
CPC .. B65H 3/5215; B65H 3/5261; B65H 3/5284; B65H 2404/1115; B65H 2404/114; B65H 2404/1321; B65H 2515/842; B65H 2601/121; B65H 7/12; B65H 3/0638; B65H 3/0684; B65H 2404/1316; B65H 2404/1317
See application file for complete search history.

(56) References Cited

U.S. PATENT DOCUMENTS 5,564,689 A * 10/1996 Fukube ..... B65H 3/5261 271/122
8,651,477 B2 2/2014 Chiba
(Continued)

FOREIGN PATENT DOCUMENTS

JP H04-313548 A 5/1992
JP H04-313548 A 11/1992

OTHER PUBLICATIONS

Yoshinao Chiba, U.S. Appl. No. 16/244,408, filed Jan. 10, 2019.

*Primary Examiner* — David H Bollinger
(74) *Attorney, Agent, or Firm* — Venable LLP

(57) ABSTRACT

A separation roller for a sheet feeding apparatus includes an outer circumferential portion formed from an elastic material, a core portion to which the outer circumferential portion is attached; and a flange portion including a plurality of projecting portions each projecting to an outside in a radial direction with respect to the core portion. At least one of the plurality of projecting portions includes a first surface provided on a side portion thereof on an upstream side in a first direction in which the separation roller rotates in such a manner as to follow the rotary feeding member rotating to feed the sheet. The first surface extends more upstream in the first direction at a position further on an outside in a radial direction with respect to a rotation axis of the separation roller as viewed in the axial direction.

20 Claims, 13 Drawing Sheets

(52) U.S. Cl.
CPC ..... *B65H 3/0684* (2013.01); *B65H 3/5215* (2013.01); *B65H 3/5261* (2013.01); *B65H 2404/1321* (2013.01); *B65H 2404/19* (2013.01)

(56) References Cited

U.S. PATENT DOCUMENTS

| | | | | |
|---|---|---|---|---|
| 9,254,973 | B2 | 2/2016 | Ishida et al. | |
| 10,155,634 | B2 | 12/2018 | Murata | |
| 2009/0322017 | A1 * | 12/2009 | Bokelman ..... | B65H 3/5261 271/264 |
| 2018/0305146 | A1 | 10/2018 | Chiba | |
| 2019/0041787 | A1 | 2/2019 | Murata | |
| 2019/0062082 | A1 | 2/2019 | Murata | |

* cited by examiner

SEPARATION ROLLER, SHEET FEEDING APPARATUS, AND IMAGE FORMING APPARATUS

BACKGROUND OF THE INVENTION

Field of the Invention

The present invention relates to a separation roller configured to separate sheets, a sheet feeding apparatus configured to feed a sheet, and an image forming apparatus configured to form an image on a sheet.

Description of the Related Art

An image forming apparatus such as a printer, a facsimile machine, or a copier includes a sheet feeding apparatus that feeds a sheet. Among examples of the sheet feeding apparatus, there is a sheet feeding apparatus that separates one sheet being fed from other sheets, by a frictional force applied from a separation roller to the sheet. For example, a configuration in which a retard roller opposing a feed roller is disposed as the separation roller and a driving force in a direction against a sheet feeding direction is input to the retard roller via a torque limiter is known. In this configuration, the retard roller rotates in such a manner as to follow the feed roller when only one sheet is entering a nip between the feed roller and the retard roller. In the case where a plurality of sheets have entered the nip, the retard roller stops or rotates in a direction against the sheet feeding direction, and thus a plurality of sheets being conveyed at once can be prevented.

An outer circumferential portion of the retard roller is normally formed from an elastic material such as rubber, and is gradually worn by repetitively feeding the sheet. In the case where the retard roller becomes slippery due to wear of the outer circumferential portion or adhesion of paper dust, the retard roller slips with respect to the feed roller, and the possibility of failure of feeding of a sheet increases. In most cases, when failure of feeding of a sheet occurs more frequently than a certain degree, information for replacing the retard roller is notified to a service person or a user. Japanese Patent Application Laid-Open No. H04-313548 discloses a configuration in which contact pressure of the retard roller on the feed roller and a torque value of the torque limiter can be changed to elongate the lifetime of the retard roller by compensating for the decrease in the friction coefficient caused by the wear.

Incidentally, in recent years, for example, the rubber material constituting the outer circumferential portion of the retard roller has improved, and thus the friction coefficient of the outer circumferential portion can be maintained at a high value even with the wear. In addition, the friction coefficient of the outer circumferential portion can be maintained at a high level even with the wear also in the case where a sheet that is not likely to generate paper dust is mainly used. In the case where the feeding of a sheet is further repeated in those situations, the outer circumferential portion becomes extremely worn, and as a result, for example, the rubber of the outer circumferential portion can break. In addition, also in the case where a method for compensating the decrease in the friction coefficient is provided as in Japanese Patent Application Laid-Open No. H04-313548, there is a possibility that the outer circumferential portion becomes extremely worn as a result of the elongation of the lifetime of the retard roller. In the case where the outer circumferential portion is broken, for example, broken pieces scatter in the apparatus, and thus an inconvenience such as the operation of replacing the retard roller becomes complicated.

SUMMARY OF THE INVENTION

According to one aspect of the invention, a sheet feeding apparatus includes: a sheet supporting portion configured to support a sheet; a rotary feeding member configured to feed the sheet supported on the sheet supporting portion; and a separation roller disposed to oppose the rotary feeding member and configured to separate one sheet fed by the rotary feeding member from another sheet in a nip portion formed between the separation roller and the rotary feeding member. The separation roller includes: an outer circumferential portion formed from an elastic material in a tubular shape and configured to come into contact with the sheet in the nip portion; a core portion to which the outer circumferential portion is attached; and a flange portion including a plurality of projecting portions provided at a plurality of positions in a circumferential direction and each projecting to an outside in a radial direction with respect to the core portion, the flange portion being disposed outside of the outer circumferential portion in an axial direction of the separation roller, wherein an outer diameter of the outer circumferential portion is larger than an outer diameter of the flange portion, and wherein at least one of the plurality of projecting portions includes a first surface provided on a side portion thereof on an upstream side in a first direction, the first direction being a rotation direction in which the separation roller rotates in such a manner as to follow the rotary feeding member rotating to feed the sheet, the first surface extending more upstream in the first direction at a position further on an outside in a radial direction with respect to a rotation axis of the separation roller as viewed in the axial direction.

According to another aspect of the invention, a sheet feeding apparatus includes: a sheet supporting portion configured to support a sheet; a rotary feeding member configured to feed the sheet supported on the sheet supporting portion; and a separation roller disposed to oppose the rotary feeding member and configured to separate one sheet fed by the rotary feeding member from another sheet in a nip portion formed between the separation roller and the rotary feeding member. The separation roller includes: an outer circumferential portion formed from an elastic material in a tubular shape and configured to come into contact with the sheet in the nip portion; a core portion configured to support an inner circumferential surface of the outer circumferential portion; and a flange portion including a plurality of projecting portions provided at a plurality of positions in a circumferential direction and each projecting to an outside in a radial direction with respect to the core portion, wherein, in a state in which the outer circumferential portion is not worn, an outer diameter of the outer circumferential portion is larger than an outer diameter of the flange portion, and wherein the plurality of projecting portions are configured such that, in a state in which the outer diameter of the outer circumferential portion has become smaller than the outer diameter of the flange portion, conveyance of the sheet by the rotary feeding member is hindered by any one of the plurality of projecting portions abutting a leading end of the sheet in a sheet feeding direction of the rotary feeding member.

According to still another aspect of the invention, a separation roller for a sheet feeding apparatus includes: an outer circumferential portion formed from an elastic material in a tubular shape and configured to come into contact with a sheet in a nip portion between the separation roller and a rotary feeding member of the sheet feeding apparatus; a core portion to which the outer circumferential portion is attached; and a flange portion including a plurality of projecting portions provided at a plurality of positions in a circumferential direction and each projecting to an outside in a radial direction with respect to the core portion, the flange portion being disposed outside of the outer circumferential portion in an axial direction of the separation roller, wherein an outer diameter of the outer circumferential portion is larger than an outer diameter of the flange portion, and wherein at least one of the plurality of projecting portions includes a first surface provided on a side portion thereof on an upstream side in a first direction, the first direction being a rotation direction in which the separation roller rotates in such a manner as to follow the rotary feeding member rotating to feed the sheet, the first surface extending more upstream in the first direction at a position further on an outside in a radial direction with respect to a rotation axis of the separation roller as viewed in the axial direction.

According to still another aspect of the invention, a separation roller for a sheet feeding apparatus includes: an outer circumferential portion formed from an elastic material in a tubular shape and configured to come into contact with a sheet in a nip portion between the separation roller and a rotary feeding member of the sheet feeding apparatus; a core portion configured to support an inner circumferential surface of the outer circumferential portion; and a flange portion including a plurality of projecting portions provided at a plurality of positions in a circumferential direction and each projecting to an outside in a radial direction with respect to the core portion, wherein, in a state in which the outer circumferential portion is not worn, an outer diameter of the outer circumferential portion is larger than an outer diameter of the flange portion, and wherein the plurality of projecting portions are configured such that, in a state in which the outer diameter of the outer circumferential portion has become smaller than the outer diameter of the flange portion, conveyance of the sheet by the rotary feeding member is hindered by any one of the plurality of projecting portions abutting a leading end of the sheet in a sheet feeding direction of the rotary feeding member.

Further features of the present invention will become apparent from the following description of exemplary embodiments with reference to the attached drawings.

DESCRIPTION OF THE EMBODIMENTS

An image forming apparatus according to the present disclosure will be described below with reference to drawings. Examples of the image forming apparatus include printers, copiers, facsimile machines, and multifunctional printers, and the image forming apparatus forms an image on a sheet on the basis of image information input from an external computer or image information read from a document. Examples of the sheet used as a recording medium include paper sheets such as regular paper sheets and cardboards, special paper sheets such as coated paper sheets, plastic films for overhead projectors, and cloths.

Figure 1:
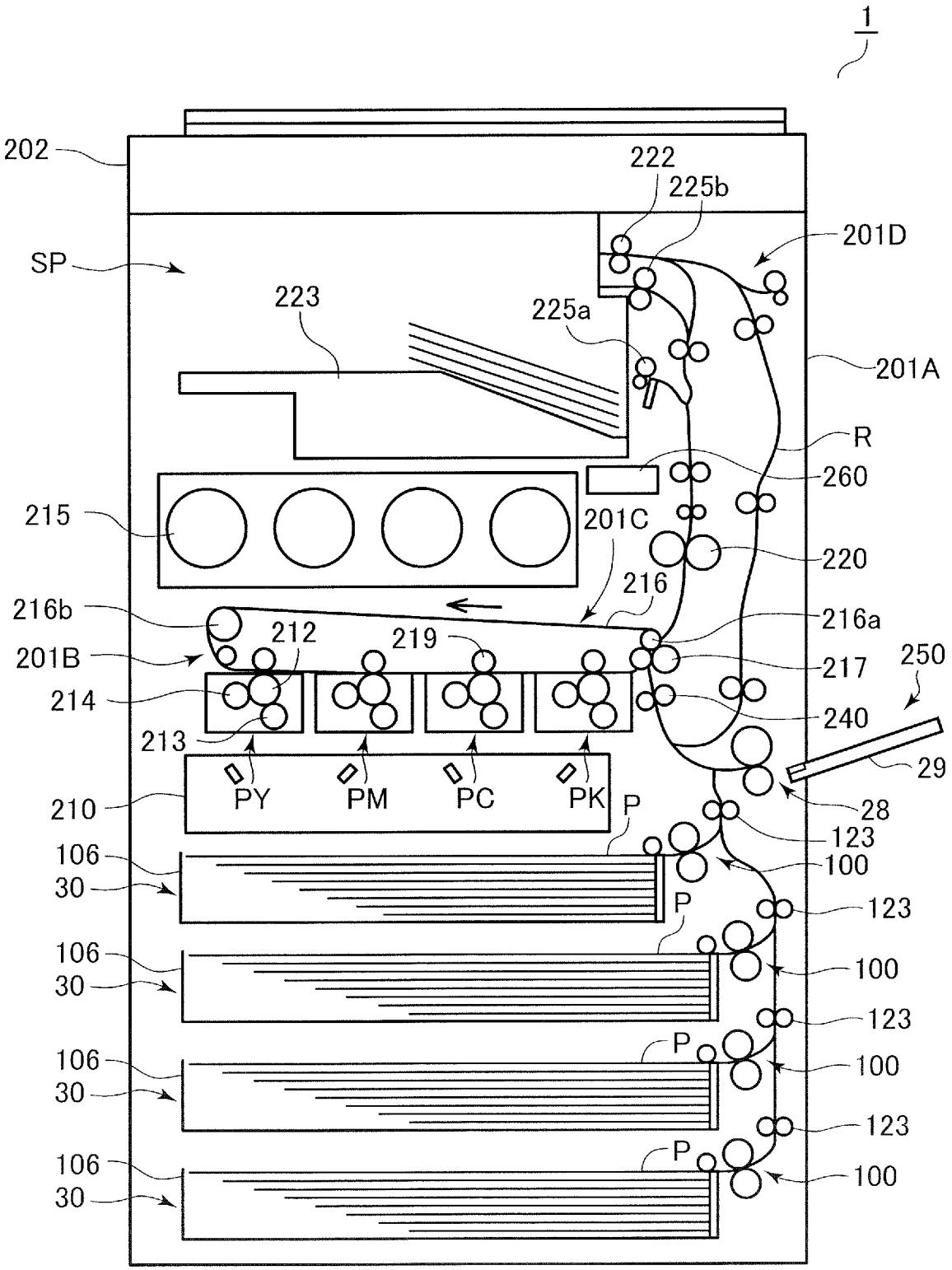
FIG. 1 is a schematic diagram illustrating an image forming apparatus according to the present disclosure.

An image forming apparatus 1 according to the present disclosure is a laser printer including an image forming portion 201B of an electrophotographic system as illustrated in FIG. 1. An image reading apparatus 202 is approximately horizontally disposed in an upper portion of an image forming apparatus body 201A, which will be hereinafter referred to as a printer body 201A. A discharge space SP for discharging sheets is defined between the image reading apparatus 202 and the printer body 201A.

The image forming portion 201B is an electrophotographic unit of a 4-drum full-color type. That is, the image forming portion 201B includes a laser scanner 210 and four process cartridges PY, PM, PC, and PK that respectively form toner images of four colors of yellow, magenta, cyan, and black. "Y", "M", "C", and "K" respectively correspond to yellow, magenta, cyan, and black. The process cartridges PY to PK each include a photosensitive drum 212 serving as a photoconductor, a charging unit 213, and a developing unit 214. In addition, the image forming portion 201B includes an intermediate transfer unit 201C disposed above the process cartridges PY to PK, and a fixing portion 220. Toner cartridges 215 for supplying toner to the respective developing units 214 are attached to a portion above the intermediate transfer unit 201C.

The intermediate transfer unit 201C includes an intermediate transfer belt 216 looped over a driving roller 216*a* and a tension roller 216*b*. Primary transfer rollers 219 abutting the intermediate transfer belt 216 at positions opposing the respective photosensitive drums 212 are provided in a space enclosed by the intermediate transfer belt 216. The intermediate transfer belt 216 is rotated counterclockwise in FIG. 1 by the driving roller 216*a* driven by an unillustrated driving portion.

A secondary transfer roller 217 that transfers a color image carried on the intermediate transfer belt 216 onto a sheet P is provided in a position opposing the driving roller 216*a* of the intermediate transfer unit 201C. The fixing portion 220 is disposed above the secondary transfer roller 217, and a first discharge roller pair 225*a*, a second discharge roller pair 225*b*, and a duplex reverse portion 201D are disposed above the fixing portion 220. In the duplex reverse portion 201D, a reverse conveyance roller pair 222 capable of rotating in a normal direction and a reverse direction, a re-conveyance path R through which a sheet on one surface of which an image has been formed is conveyed to the image forming portion 201B again, and so forth are provided. In addition, the image forming apparatus 1 includes a controller 260 as a control unit that controls an image forming operation, a sheet feeding operation, and so forth.

The image forming operation of the image forming portion 201B will be described. Image information of a document is read by the image reading apparatus 202, subjected to image processing by the controller 260, and then converted into an electric signal and transmitted to the laser scanner 210 of the image forming portion 201B. In the image forming portion 201B, the surfaces of the photosensitive drums 212 uniformly charged to predetermined polarity and potential by the charging units 213 are irradiated with laser light from the laser scanner 210, and thus are exposed in accordance with the rotation thereof. As a result of this, electrostatic latent images corresponding to respective monochromatic images of yellow, magenta, cyan, and black are formed on the surfaces of the respective photosensitive drums 212 of the process cartridges PY to PK. These electrostatic latent images are developed into visual images by toners of respective colors supplied from the developing units 214, and then the visual images are transferred from the photosensitive drums 212 onto the intermediate transfer belt 216 by a primary transfer bias applied to the primary transfer rollers 219 so as to be superimposed on one another through primary transfer.

In parallel with such an operation, sheets P are fed one by one from any one of sheet feeding portions 30 and 250 toward a registration roller pair 240. In a lower portion of the printer body 201A, a plurality of sheet feeding portions 30 each including a cassette 106 accommodating the sheets P and a sheet feed unit 100 that feeds the sheets P accommodated in the cassette 106 are disposed. The configuration of the sheet feed units 100 will be described later.

A sheet feed unit 100 feeds one uppermost sheet at a time from the sheets P accommodated in the cassette 106. The sheet P fed out by the sheet feed unit 100 is conveyed upward toward the registration roller pair 240 via a conveyance roller pair 123. In addition, in the manual sheet feed portion 250 provided on a side portion of the printer body 201A, a sheet set on a manual feed tray 29 is fed toward the registration roller pair 240 by a sheet feed unit 28.

The registration roller pair 240 corrects the skew of the sheet P, and then feeds out the sheet P toward the secondary transfer roller 217 in accordance with the progress of toner image formation by the image forming portion 201B. In a secondary transfer portion formed between the secondary transfer roller 217 and the intermediate transfer belt 216, a full-color toner image is collectively transferred onto the sheet P through secondary transfer as a result of a secondary transfer bias applied to the secondary transfer roller 217. The sheet P onto which the toner image has been transferred is conveyed to the fixing portion 220, toners of respective colors are melted and mixed by heat and pressure applied in the fixing portion 220, and thus the toner image is fixed on the sheet P as a color image.

Then, the sheet P is discharged onto a discharge portion 223 disposed at a bottom portion of the discharge space SP by the first discharge roller pair 225*a* or the second discharge roller pair 225*b* provided downstream of the fixing portion 220. When images are to be formed on both surfaces of the sheet P, the sheet P on a first surface of which an image has been formed is conveyed to the re-conveyance path R and then to the image forming portion 201B again in a state of being reversed by the reverse conveyance roller pair 222. Then, an image is also formed on the second surface of the sheet P by the image forming portion 201B, and the sheet P is discharged onto the discharge portion 223 by the first discharge roller pair 225*a* or the second discharge roller pair 225*b*.

To be noted, the image forming portion 201B described above is an example of an image forming portion, and an image forming portion of a direct transfer type that directly transfers a toner image formed on a photosensitive member may be also used. In addition, an image forming portion of an inkjet system or an offset printing system may be used instead of an electrophotographic system.

Sheet Feeding Portion

Figure 2A:
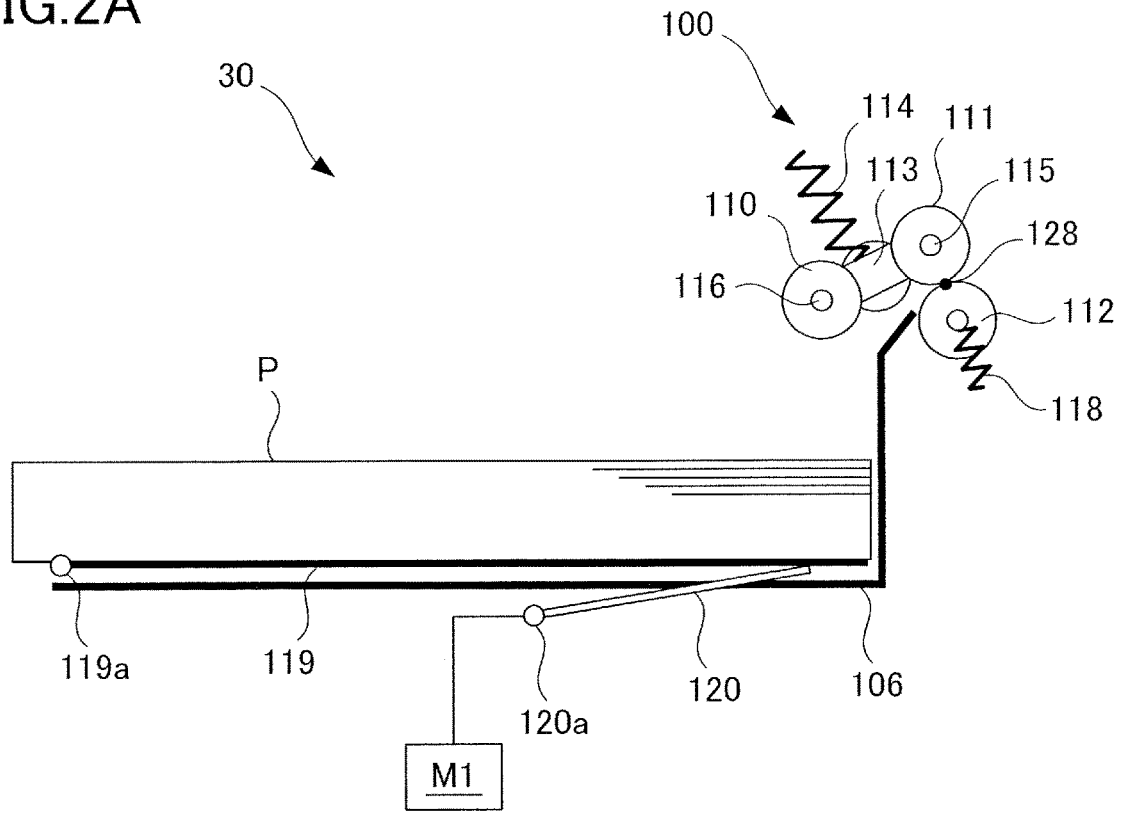
FIG. 2A is a schematic diagram illustrating a sheet feeding portion in the case where an inner plate is at a standby position.
Figure 2B:
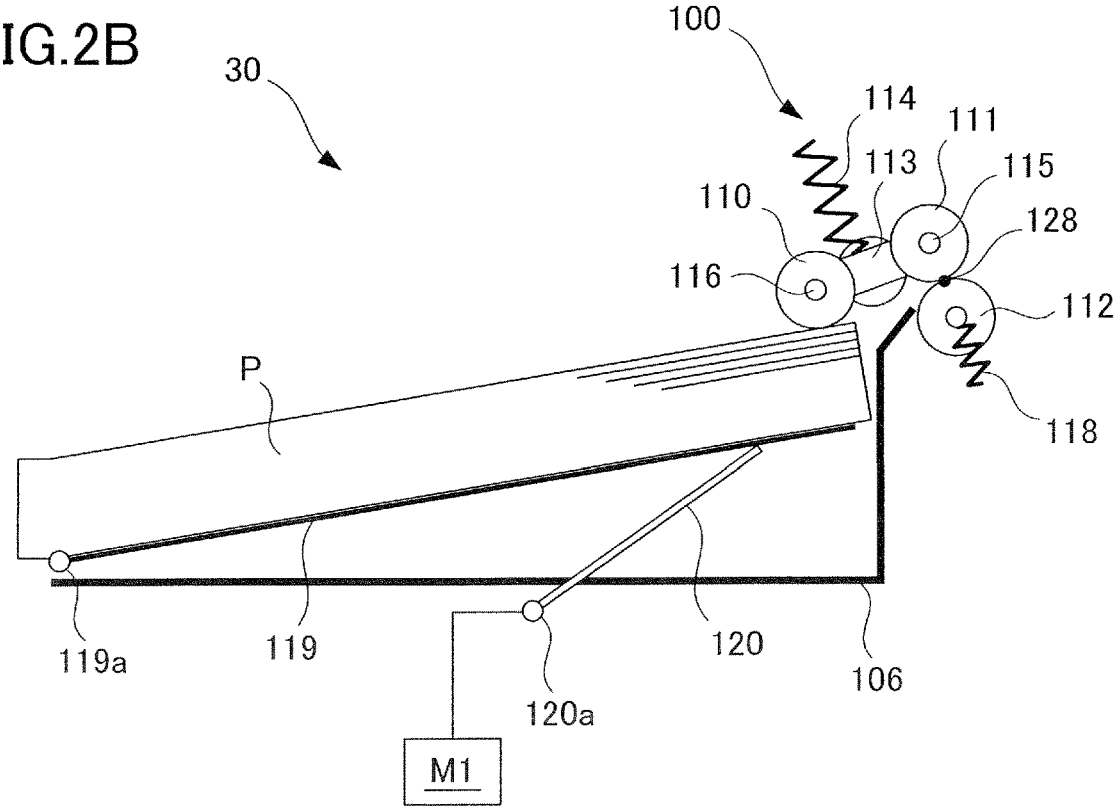
FIG. 2B is a schematic diagram illustrating the sheet feeding portion in the case where the inner plate is at a sheet feeding position.

The configuration of a sheet feeding portion 30 serving as an example of a sheet feeding apparatus will be described. The sheet feeding portion 30 includes the cassette 106 serving as a sheet supporting portion and the sheet feed unit 100 that feeds a sheet supported in the cassette 106 as illustrated in FIGS. 2A and 2B. The cassette 106 is detachably attached to the printer body 201A illustrated in FIG. 1. That is, the cassette 106 is attached to the printer body 201A such that the cassette 106 can be drawn out from the printer body 201A.

The cassette 106 is provided with an inner plate 119 serving as a sheet support portion that supports sheets, and an ascending/descending plate 120 that supports the inner plate 119 and causes the inner plate 119 to ascend and descend. The inner plate 119 is capable of pivoting in an up direction and a down direction, that is, ascending and descending around a pivot shaft 119*a*. The ascending/descending plate 120 is disposed below the inner plate 119, and pivoted in the up and down directions about an ascending/ descending shaft 120*a* by an ascending/descending motor M1. The inner plate 119 is pressed from below by the ascending/descending plate 120, and thus ascends from a standby position illustrated in FIG. 2A to a sheet feeding position illustrated in FIG. 2B. Then, when the inner plate 119 reaches the sheet feeding position, the sheet P supported on the inner plate 119 abuts a pickup roller 110 of the sheet feed unit 100.

The sheet feed unit 100 incudes the pickup roller 110, a feed roller 111, and a retard roller 112. The feed roller 111 is an example of a rotary feeding member that feeds the sheet P supported in the cassette 106. The retard roller 112 serving as an example of a separation roller is disposed to oppose the feed roller 111, and forms a separation nip 128 to separate one sheet P from sheets P as a nip portion between the retard roller 112 and the feed roller 111. The separation nip 128 will be hereinafter simply referred to as a nip 128.

Figure 3:
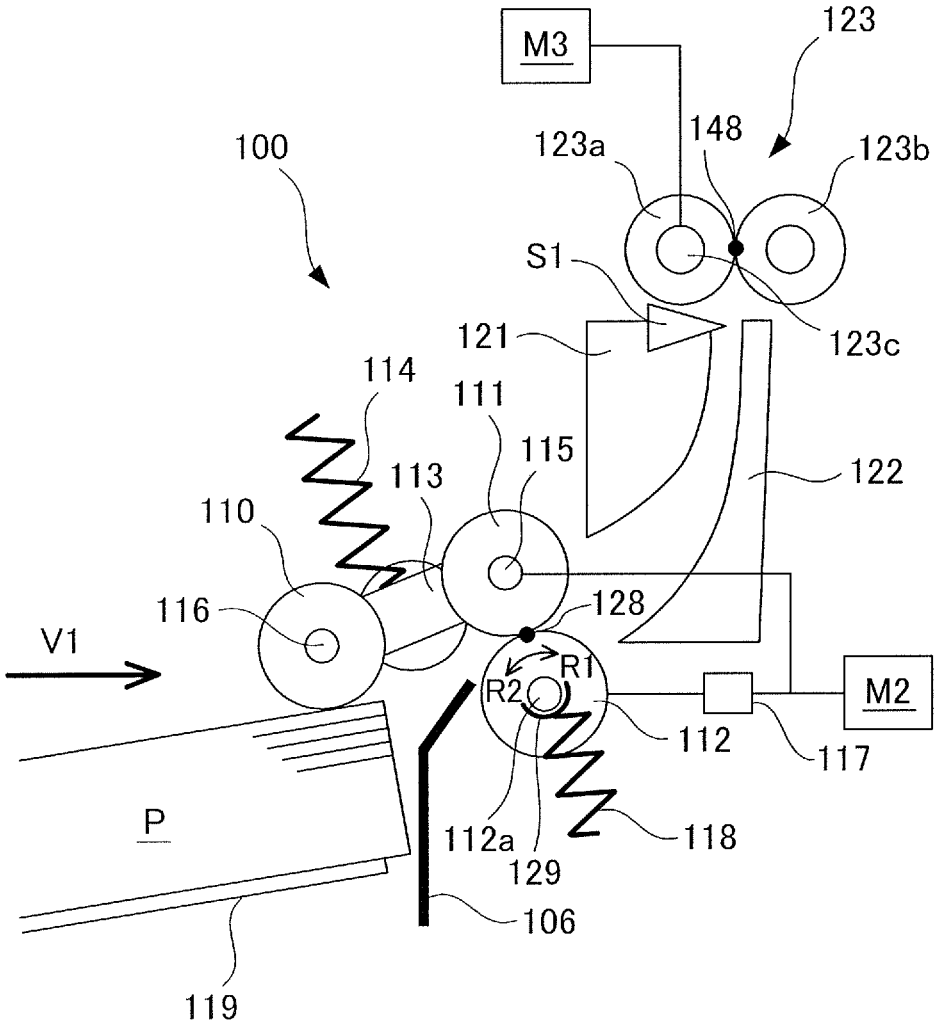
FIG. 3 is an enlarged view of a sheet feed unit and the surroundings thereof.
Figure 4:
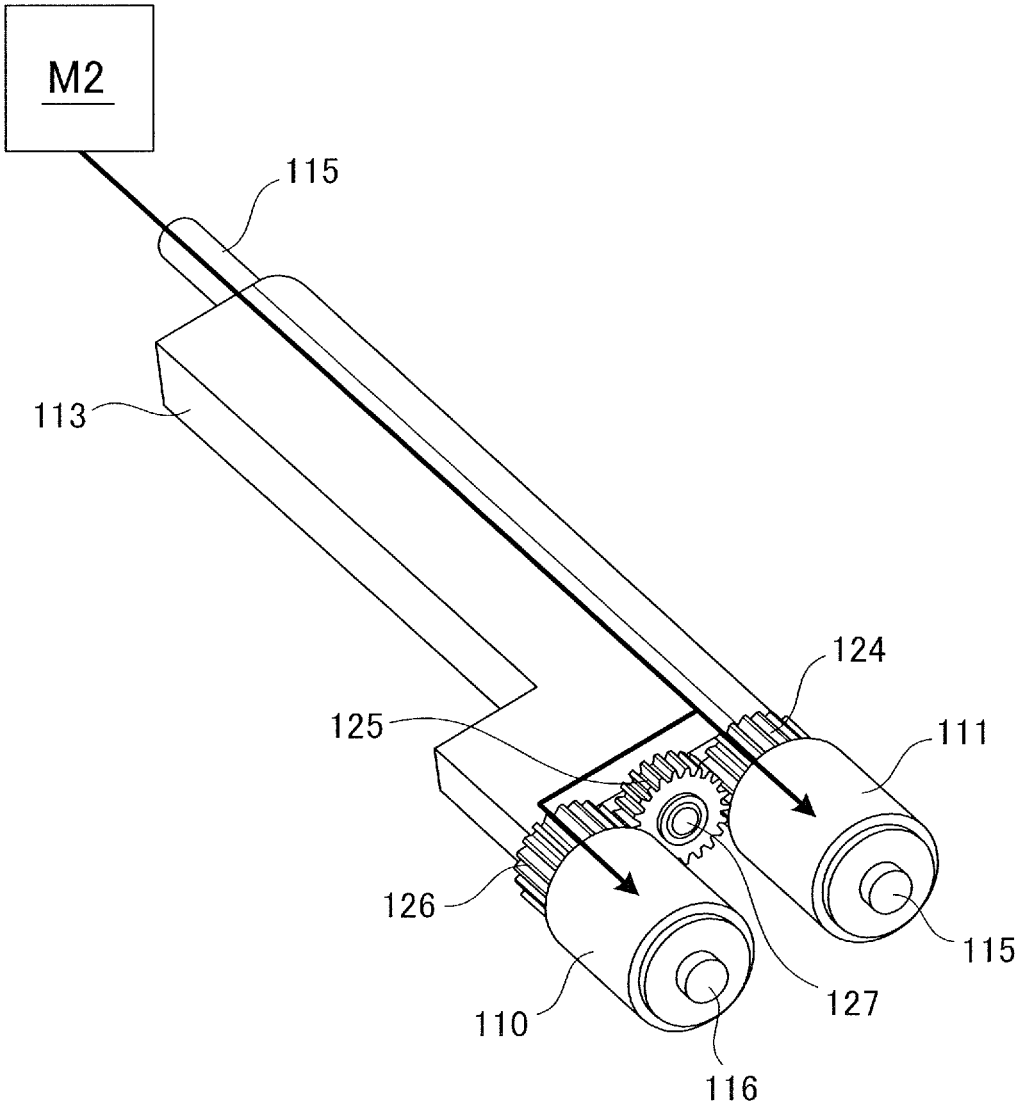
FIG. 4 is a diagram for describing driving configurations of a feed roller and a pickup roller.

FIG. 3 is a schematic diagram illustrating a sectional configuration of the sheet feed unit 100 as viewed in the width direction of the sheet perpendicular to a sheet feeding direction V1, that is, as viewed in the axial direction of the rollers 110 to 112. FIG. 4 is a perspective view of the pickup roller 110 and the feed roller 111 for describing a driving configuration thereof. As illustrated in FIGS. 3 and 4, the feed roller 111 is rotatably supported by a feed roller shaft 115 driven by a sheet feed motor M2. An ascending/descending plate 113 supporting the pickup roller 110 is capable of swinging in an up direction and a down direction about the feed roller shaft 115.

The ascending/descending plate 113 rotatably supports an idler shaft 127 and a pickup roller shaft 116, and the pickup roller shaft 116 rotatably supports the pickup roller 110. In addition, a feed gear 124, an idler gear 125, and a pickup gear 126 are respectively attached to the feed roller shaft 115, the idler shaft 127, and the pickup roller shaft 116. The feed gear 124, the idler gear 125, and the pickup gear 126 transmit the driving force of the sheet feed motor M2 to the pickup roller shaft 116 via the feed roller shaft 115. That is, the driving force of the sheet feed motor M2 serving as a drive source rotates the pickup roller 110 and the feed roller 111 in rotation directions along the sheet feeding direction V1, which is counterclockwise in FIG. 3.

The ascending/descending plate 113 is urged downward by a pickup spring 114 serving as an urging member. When the inner plate 119 is in the sheet feeding position, the urging force of the pickup spring 114 causes the pickup roller 110 to abut the upper surface of the sheet P at a predetermined feeding pressure. The retard roller 112 is supported by a retard shaft 112*a*, and the retard shaft 112*a* is rotatably supported by a bearing portion 129 serving as a support member. The bearing portion 129 is capable of moving in such directions as to move closer to and away from the feed roller 111, and is urged toward the feed roller 111 by a retard spring 118 serving as an urging member. As a result of this, the retard roller 112 abuts the feed roller 111 at the nip 128 by a predetermined pressurizing force.

In addition, the retard shaft 112*a* is coupled to the sheet feed motor M2 via a torque limiter 117 as illustrated in FIG. 3. As a result of this, the retard roller 112 is capable of driving in a rotation direction opposite to the sheet feeding direction of the feed roller 111 by the driving force from the sheet feed motor M2 serving as a drive source. In addition, the torque limiter 117 allows the retard roller 112 to rotate in such a manner as to follow the feed roller 111 in the case where a force greater than a torque of predetermined value is applied to the retard roller 112 in a direction following the feed roller 111. Hereinafter, among rotation directions of the retard roller 112, the direction in which the retard roller 112 rotates in such a manner as to follow the feed roller 111 along the sheet feeding direction V1, which is clockwise in FIG. 3, will be referred to as a "following direction R1", and a direction opposite thereto will be referred to as a "reverse direction R2". The following direction R1 is a direction in which the retard roller 112 rotates, at a position in which the feed roller 111 and the retard roller 112 are opposed to each other, in the same direction as the feed roller 111 feeding a sheet, and is a first direction in the present disclosure. The reverse direction R2 is a direction in which the retard roller 112 rotates, at the same position, against the feed roller 111, and is a second direction in the present disclosure.

An inner guide 121, an outer guide 122, and a conveyance roller pair 123 are disposed downstream of the feed roller 111 and the retard roller 112 in the sheet feeding direction V1. The conveyance roller pair 123 includes a driving roller 123*a* and a driven roller 123*b*, and the driving roller 123*a* is rotatably supported by a rotation shaft 123*c*. Further, the rotation shaft 123*c* is driven by a conveyance motor M3, and thus the driving roller 123*a* rotates, and the driven roller 123*b* is rotated by the driving roller 123*a*. In the sheet feeding direction V1, a conveyance sensor S1 that detects a sheet is disposed upstream of a conveyance nip 148 formed by the driving roller 123*a* and the driven roller 123*b* and downstream of the nip 128. The conveyance sensor S1 is an example of a sheet detection portion that detects a sheet at a position downstream of the rotary feeding member in the sheet feeding direction V1.

Sheet Feeding Operation

A sheet feeding operation by the sheet feeding portion 30 will be described. When a sheet feed job is input or the cassette 106 is inserted in the printer body 201A, driving of the ascending/descending motor M1 starts, and the inner plate 119 ascends. The position of the uppermost sheet supported on the inner plate 119 is detected by an unillustrated sensor, and as illustrated in FIG. 2B, the inner plate 119 stops when the uppermost sheet reaches a predetermined height.

When the sheet feed motor M2 and the conveyance motor M3 drive in this state, the pickup roller 110 feeds a sheet supported on the inner plate 119. One sheet P is separated from sheets P fed out by the pickup roller 110 at the nip 128. Specifically, when only one sheet enters the nip 128, the torque limiter 117 present in a drive transmission path from the sheet feed motor M2 to the retard roller 112 slips, and thus the rotation of the retard roller 112 in the following direction R1 is allowed as illustrated in FIG. 3. In addition, in a state in which two or more sheets have entered the nip 128, the retard roller 112 rotates in the reverse direction R2, thus causing sheets below an uppermost sheet to slip with respect to the uppermost sheet, and preventing a plurality of sheets P from passing through the nip 128. However, this description applies to a case where the amount of wear of the outer circumferential portion of the retard roller 112 is small. An operation in the case where the retard roller 112 has been worn will be described later.

The one sheet separated in the nip 128 is guided to the conveyance roller pair 123 by the inner guide 121 and the outer guide 122, and is further conveyed through the conveyance nip 148 of the conveyance roller pair 123. To be noted, although the conveyance speeds of sheet by the pickup roller 110, and at the nip 128 and at the conveyance nip 148 (that is, peripheral speeds of the feed roller 111 and the driving roller 123*a*) are set to equal values, the configuration is not limited to this. For example, the productivity may be improved by setting the conveyance speed of a sheet at the conveyance nip 148 to be higher than the conveyance speed of a sheet by the pickup roller 110 and at the nip 128. In this case, it is preferable that the pickup roller 110 and the feed roller 111 each include a one-way clutch that allows relative rotation with respect to the corresponding roller shaft 115 or 116. As a result of this, after the leading end of the sheet reaches the conveyance nip 148, drive coupling between the sheet feed motor M2 and the rollers 110 and 111 is released, and thus the sheet can be prevented from being pulled in opposite directions between the conveyance nip 148 and the nip 128.

First Exemplary Embodiment

The retard roller 112 serving as a separation roller of a first exemplary embodiment will be described below with reference to FIGS. 5A to 10.

Figure 5A:
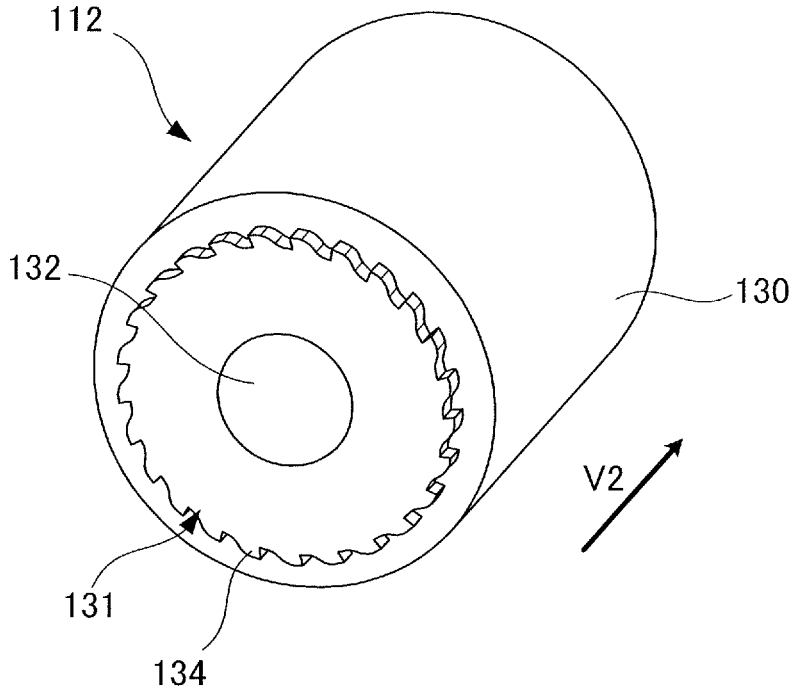
FIG. 5A is a perspective view of a retard roller according to a first exemplary embodiment.
Figure 5B:
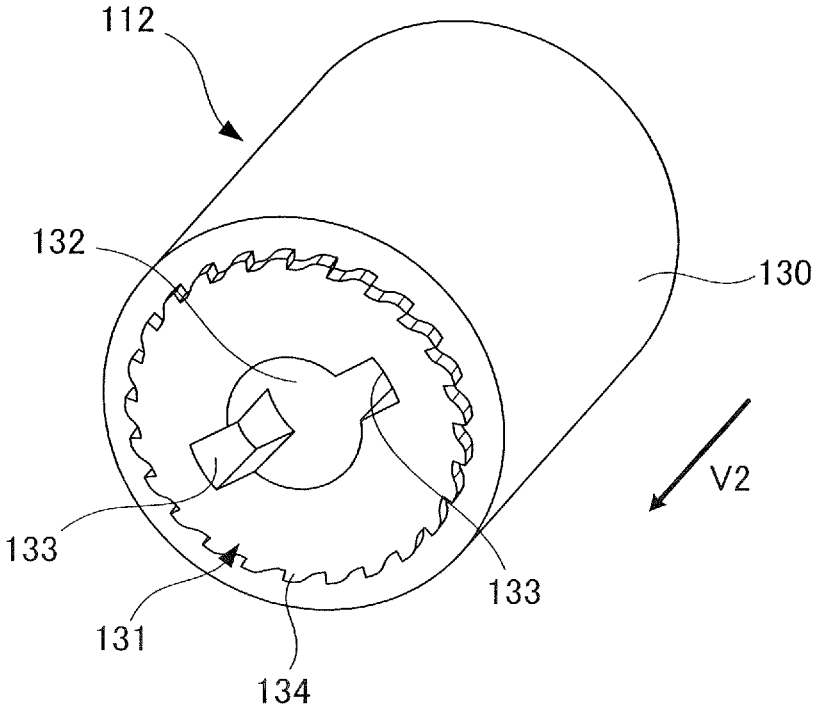
FIG. 5B is a perspective view of the retard roller according to the first exemplary embodiment.
Figure 6A:
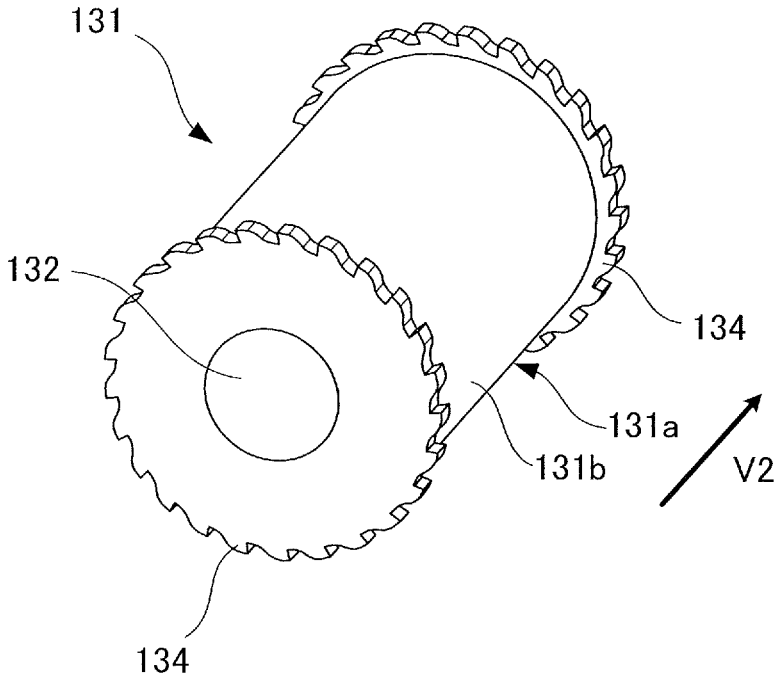
FIG. 6A is a perspective view of a roller core of the retard roller according to the first exemplary embodiment.
Figure 6B:
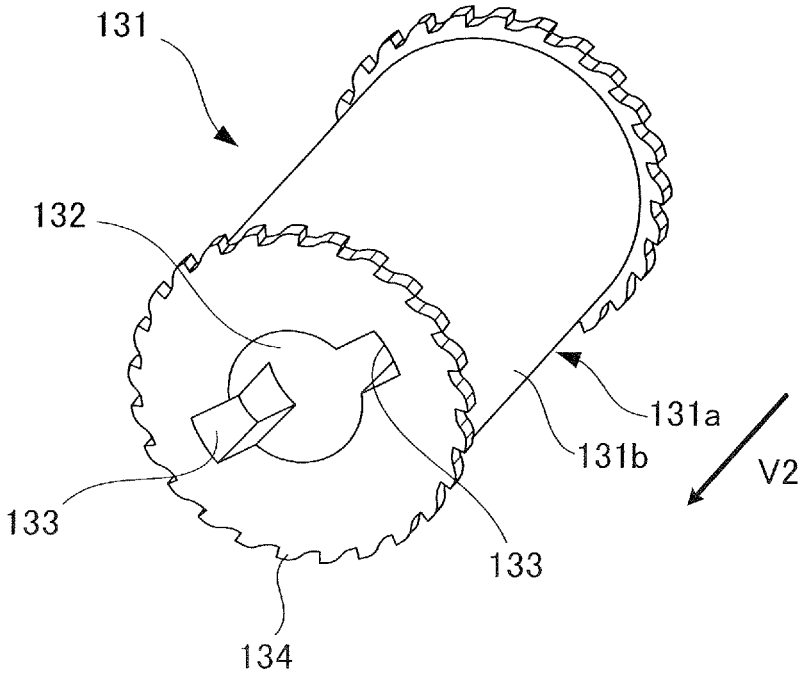
FIG. 6B is a perspective view of the roller core of the retard roller according to the first exemplary embodiment.

FIGS. 5A and 5B are each a perspective view of the retard roller 112 according to the present exemplary embodiment. FIG. 5A illustrates the retard roller 112 as viewed from the front side with respect to an attaching direction of the retard roller 112 to the retard shaft 112*a*. FIG. 5B illustrates the retard roller 112 as viewed from the rear side with respect to the attaching direction. FIG. 6A illustrates a roller core 131 in a state in which a roller rubber 130 constituting an outer circumferential portion of the retard roller 112 is detached. An arrow V2 in this figure indicates the attaching direction of the retard roller 112 to the retard shaft 112*a* among axial directions thereof, that is, directions along the rotation axis thereof.

As illustrated in FIGS. 5A and 5B, the retard roller 112 is constituted by the roller core 131 formed from a resin material and the roller rubber 130 formed from a rubber material. The roller rubber 130 has a tubular shape, and is attached to the roller core 131 by being looped around a core body 131*a* of the roller core 131. The core body 131*a* serving as a core portion of the present exemplary embodiment supports the inner circumferential surface of the roller rubber 130 on an outer circumferential surface 131*b* having a cylindrical shape, and rotates integrally with the roller rubber 130.

Each side of the core body 131*a* of the roller core 131 in the axial direction thereof is provided with a flange 134. The flanges 134 serving as flange portions of the present exemplary embodiment each have a recess/projection shape in which a plurality of projecting portions 140 are arranged at a constant pitch in the circumferential direction. The shape and effect of this recess/projection shape will be described later in detail. In addition, on the roller core 131, a shaft hole 132 in which the retard shaft 112*a* is inserted and grooves 133 for coupling the torque limiter 117 thereto are defined as illustrated in FIG. 5B. The retard roller 112 becomes capable of receiving the driving force from the sheet feed motor M2 as a result of a key provided on the torque limiter 117 engaging with the grooves 133.

Wear of Roller

Incidentally, the wear of each roller used in the sheet feeding portion 30 progresses due to friction of contact with the sheet as the sheet feeding operation is repetitively performed. Especially, the wear is prominent on the retard roller 112 to which a driving force in the reverse direction is input via a torque limiter as in the present exemplary embodiment.

As the thickness of the roller rubber 130 decreases by the wear, the strength of the roller rubber 130 decreases. When the roller rubber 130 is extremely worn, a possibility that the roller rubber 130 eventually breaks arises. In the case where the roller rubber 130 breaks, pieces of the broken rubber need to be collected when replacing the retard roller 112, and therefore the replacement becomes more complicated. In addition, in the case where the sheet feeding operation is started in the state in which the roller rubber 130 is broken, there is a possibility that the separation of sheet cannot be normally performed and multiple conveyance occurs.

Recess and Projection of Flange Portion

Therefore, in the present exemplary embodiment, with the recess/projection shape provided on the flanges 134 of the roller core 131, the retard roller 112 is configured to automatically stop the feeding of the sheet before wear progresses to such an extent that the breakage of the roller rubber 130 can occur. The recess/projection shape of the flanges 134 will be described below.

Figure 7A:
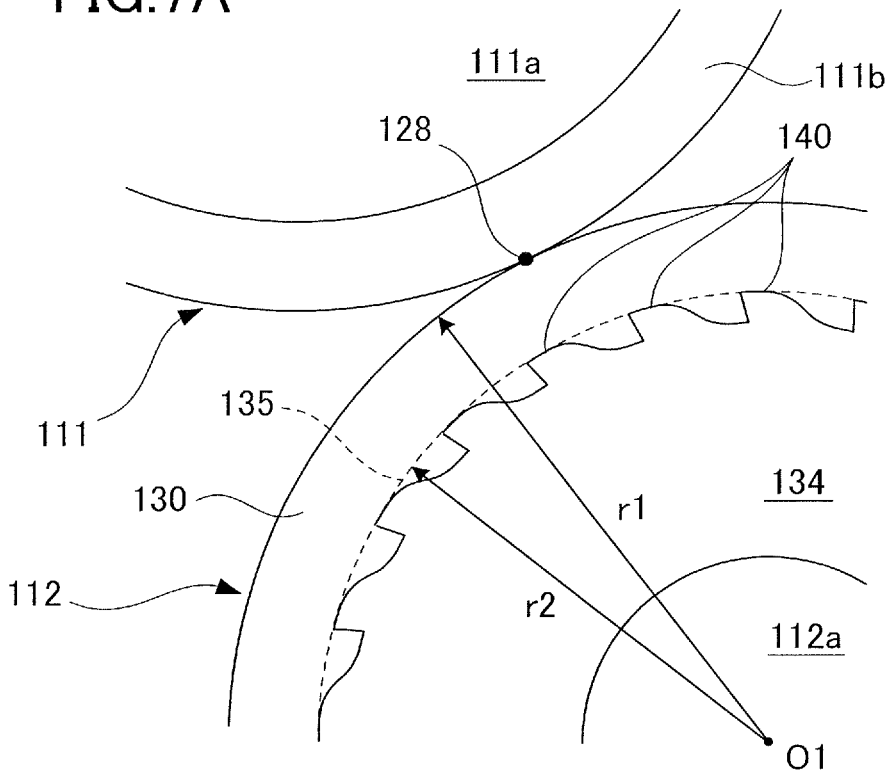
FIG. 7A is a schematic diagram illustrating the state of the vicinity of a separation nip in an initial state in the first exemplary embodiment.
Figure 7B:
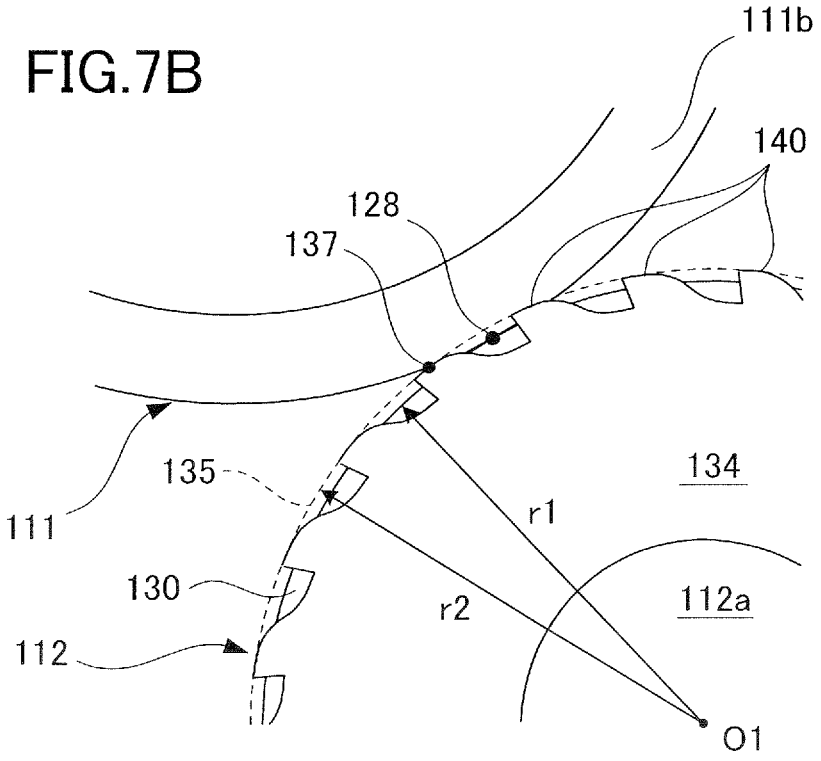
FIG. 7B is a schematic diagram illustrating the state of the vicinity of the separation nip in a state in which roller rubber has been worn in the first exemplary embodiment.
Figure 8A:
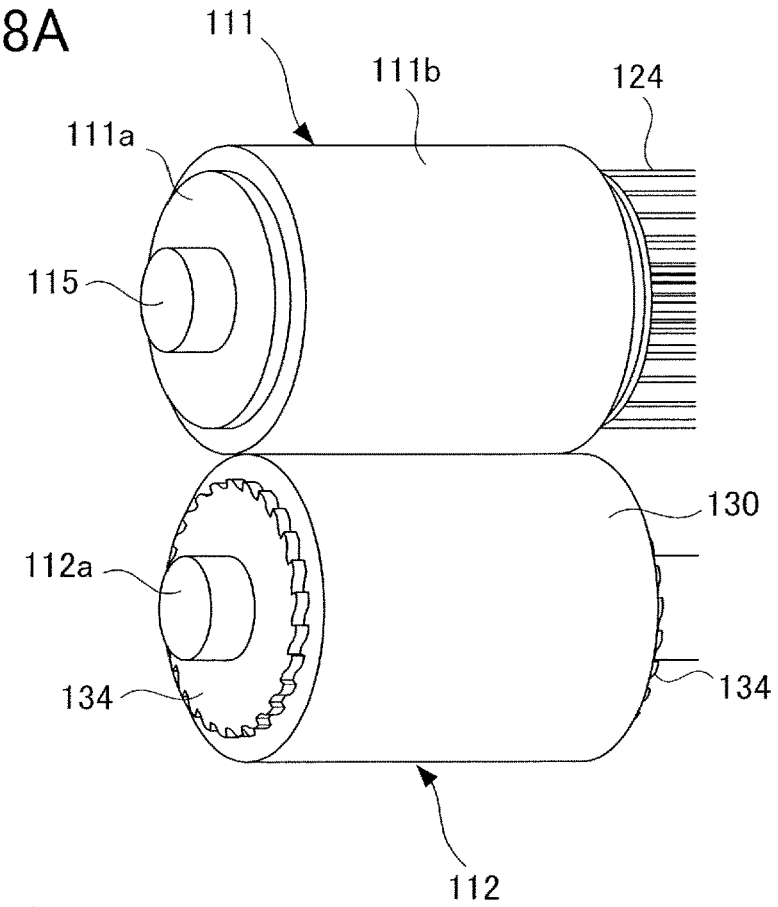
FIG. 8A is a perspective view of a retard roller and a feed roller in the initial state in the first exemplary embodiment.
Figure 8B:
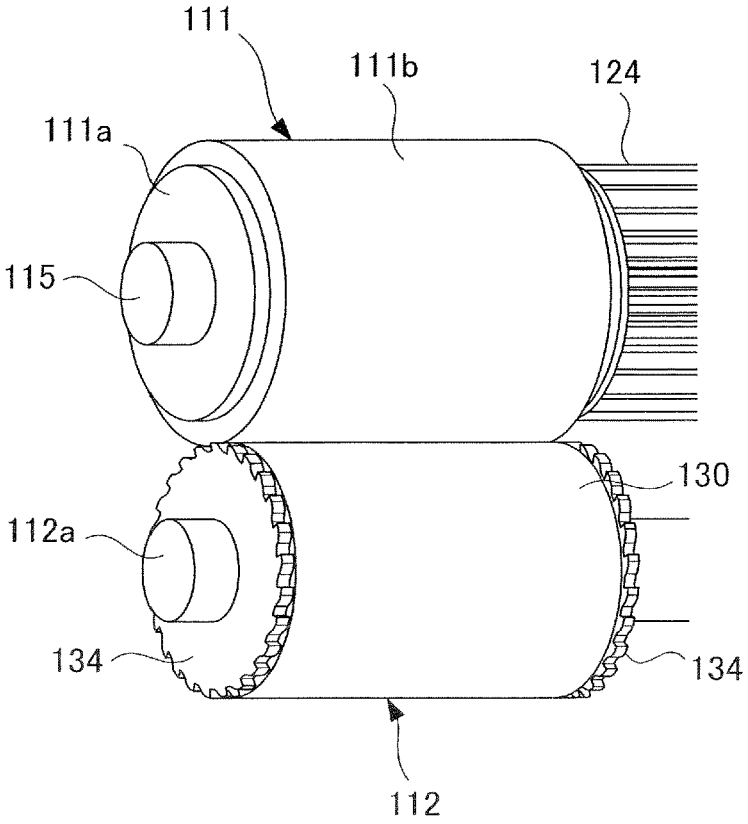
FIG. 8B is a perspective view of the retard roller and the feed roller in the state in which the roller rubber has been worn in the first exemplary embodiment.

FIGS. 7A and 7B are each a schematic diagram illustrating the vicinity of the nip 128 of the sheet feeding portion 30 as viewed in the axial direction of the retard roller 112, and FIGS. 8A and 8B are each a perspective view of the feed roller 111 and the retard roller 112. FIGS. 7A and 8A illustrate an initial state, that is, a state in which the roller rubber 130 of the retard roller 112 is not worn, and FIGS. 7B and 8B illustrate a state in which the roller rubber 130 has been worn.

As illustrated in FIGS. 7A and 8A, in the initial state, the outer diameter r1 of the roller rubber 130 is larger than the outer diameter r2 of the flanges 134, that is, r1>r2 holds, and the outlines of the flanges 134 are inside the outer circumferential surface of the roller rubber 130 as viewed in the axial direction. To be noted, a point O1 represents the rotation axis of the retard roller 112. In the initial state, the retard roller 112 comes into contact with a sheet at the roller rubber 130, and the flanges 134 are separated from the sheet passing through the nip 128. That is, the flanges 134 are configured not to affect the conveyance of sheet in the initial state.

As the wear of the retard roller 112 progresses, the outer diameter r1 of the roller rubber 130 decreases, and becomes closer to the outer diameter r2 of the flanges 134. In a state in which the outer diameter r1 of the roller rubber 130 is approximately equal to the outer diameter r2 of the flanges 134, that is, in a state in which r1≈r2 holds, the sheet is fed in contact with both of the roller rubber 130 and the flanges 134. In the case where the feeding of sheet is repeated in this state, wear of both of the roller rubber 130 and the flanges 134 progresses. However, due to the difference in material, the wear of the roller rubber 130 progresses much faster than the wear of the flanges 134. As a result of this, the outer diameter r1 of the roller rubber 130 becomes smaller than the outer diameter r2 of the flanges 134, that is, r1<r2 holds. The outer diameter r2 corresponds to the furthest points of the projecting portions 140. To be noted, although it can be considered that the outer diameter of the roller rubber 130 varies to some extent between positions in the axial direction depending on the state of the wear, the outer diameter r1 described above is set to an average value of the outer diameter in the entire length in the axial direction.

Here the roller widths of the feed roller 111 and the retard roller 112 are the same, and the two flanges 134 are disposed outside a region where the outer circumferential surface of the feed roller 111 is provided in the axial direction. The roller width refers to the length in the axial direction of a portion constituting an outer circumferential portion of a roller member that comes into contact with a sheet, for example, a roller rubber 111*b* or 130. In addition, the feed roller 111 also has a configuration in which the inner circumferential surface of the roller rubber 111*b* formed from a rubber material is supported by a roller core 111*a* formed from a resin material similarly to the retard roller 112.

In a state in which the roller rubber 130 of the retard roller 112 has been worn to a certain degree or more, the projecting portions 140 of the flanges 134 project further toward the feed roller 111 than the nip 128 as viewed in the axial direction as illustrated in FIG. 7B. In other words, a rotation trajectory 135 of the projecting portions 140 of the flanges 134 indicated by a broken line becomes partially overlapping the feed roller 111 as viewed in the axial direction.

Operation in the Case Where Roller Rubber has Been Worn

An operation performed in the case where feeding of a sheet is started in a state in which the roller rubber of the retard roller 112 has been worn will be described with reference to FIGS. 9A to 9D. FIGS. 9A to 9D are each a schematic diagram illustrating the vicinity of the nip 128 as viewed in the axial direction, and illustrate how the operation progresses in the order from FIG. 9A to FIG. 9D.

After the sheet feeding operation is started, the pickup roller 110 and the feed roller 111 rotate in the direction along the sheet feeding direction, which is counterclockwise in the figure. First, the sheet P receives a force from the pickup roller 110, and moves toward the nip 128. At this time, the roller rubber 130 of the retard roller 112 is abutting the feed roller 111 in the nip 128, and the retard roller 112 is rotated in the following direction R1 by a frictional force from the feed roller 111 as illustrated in FIG. 9A.

Figure 9A:
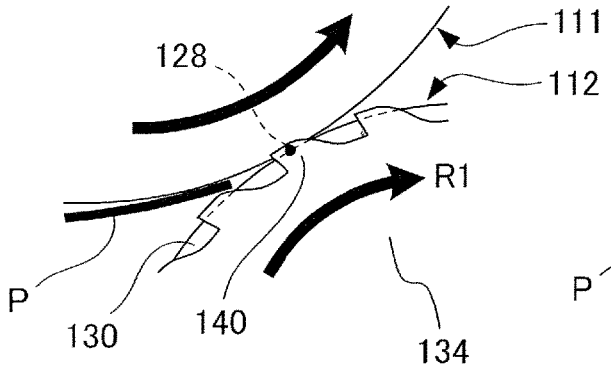
FIG. 9A is a diagram for describing an operation in the case where feeding of a sheet is started in the state in which the roller rubber has been worn in the first exemplary embodiment.
Figure 9B:
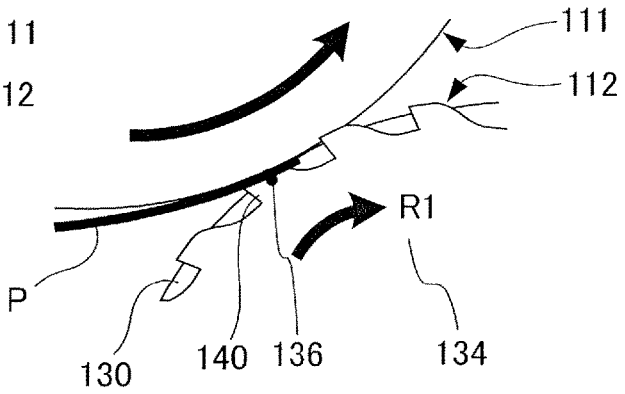
FIG. 9B is another diagram for describing the operation in the first exemplary embodiment.
Figure 9C:
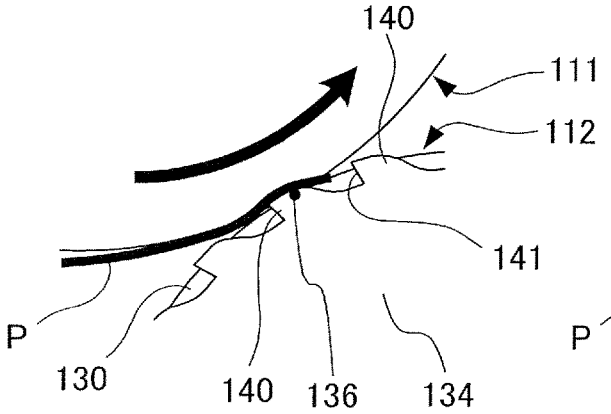
FIG. 9C is another diagram for describing the operation in the first exemplary embodiment.

When the leading end of the sheet P, that is, a downstream end thereof in the sheet feeding direction approaches the nip 128, the sheet P comes into contact with the flanges 134, and is nipped between the feed roller 111 and the flanges 134 as illustrated in FIGS. 9B and 9C. That is, when the leading end of the sheet P enters a region downstream of a point 137, in which the rotation trajectory 135 of the flanges 134 crosses the outer circumferential surface of the feed roller 111, in the sheet feeding direction, the upper surface of the sheet P abuts the feed roller 111, and the lower surface of the sheet P abuts the flanges 134.

In this case, the retard spring 118 illustrated in FIG. 3 that has generated the pressurizing force of the nip 128, which corresponds to an integral value of nip pressure, in the state of FIG. 9A is at least partially dissipated to the outside of the nip 128 through a contact portion 136 between the flanges 134 and the sheet P. In other words, part of the force of the retard spring 118 pressing the retard roller 112 toward the feed roller 111 acts as a force pressing the sheet P against the elasticity of the sheet P. As a result, the pressurizing force acting in the nip 128 in the states of FIGS. 9B and 9C is smaller than a pressurizing force N in the state of FIG. 9A.

Here, the magnitude of force of the feed roller 111 to rotate the retard roller 112 in each state of FIGS. 9A to 9C is roughly calculated to describe the operation of the retard roller 112.

A friction coefficient between the feed roller 111 and the retard roller 112 in the nip 128 is set as μ1.

A friction coefficient between the sheet P and the flanges 134 is set as μ2.

A pressurizing force acting in the nip 128 in the state of FIG. 9A is set as N.

A pressurizing force acting in the nip 128 in the state of FIG. 9C is set as N1.

A pressurizing force acting in the contact portion 136 in the state of FIG. 9C is set as N2.

The relationship between N, N1, and N2 can be expressed by N=N1+N2.

In the state of FIG. 9A, a force F1 of the feed roller 111 to rotate the retard roller 112 in the following direction R1 is caused by a frictional force between roller rubber generated in the nip 128. Therefore, the value of F1 is expressed as follows.

$$F1=\mu 1\times N \tag{1}$$

When the state transitions from the state of FIG. 9A to states of FIGS. 9B and 9C, the force F1 of the feed roller 111 to rotate the retard roller 112 in the following direction R1 changes to a force F3 via a force F2. The forces F2 and F3 are respectively expressed as follows.

$$F1=\mu 1\times N1+\mu 2\times N2 \tag{2}$$

$$F3=\mu 2\times N \tag{3}$$

The formula (2) expresses a state in which one part of the rotational force of the feed roller 111 is transmitted as a frictional force μ1×N1 between the feed roller 111 and the retard roller 112 and the other part of the rotational force is transmitted as a frictional force μ2×N2 in the contact portion 136 between the sheet P and the flanges 134. The formula (3) expresses a state in which the rotation of the feed roller 111 is mainly transmitted as a frictional force in the contact portion 136 between the sheet P and the flanges 134.

Figure 9D:
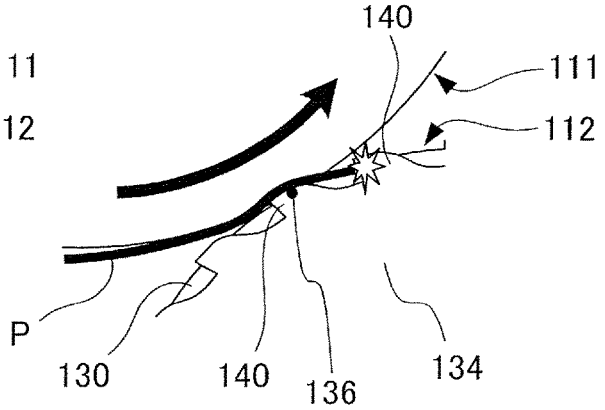
FIG. 9D is another diagram for describing the operation in the first exemplary embodiment.

Generally, the friction coefficient between the sheet P and a material constituting the roller core 131 is smaller than the friction coefficient μ1 between the feed roller 111 and the retard roller 112 and the friction coefficient between the retard roller 112 and the sheet P. Whereas the former two friction coefficients are typically both equal to or larger than 1, the latter friction coefficient is equal to or smaller than 0.5 in most cases. Therefore, the force to rotate the retard roller 112 in the following direction R1 becomes smaller from F1 to F2 and from F2 to F3. As a result, as illustrated in FIG. 9D, the retard roller 112 rotates in the reverse direction or stops due to the force in the reverse direction transmitted through the torque limiter 117. Then, the leading end of the sheet P is caught by the projecting portions 140 of the flanges 134, and thus the conveyance of the sheet P is hindered.

Figure 9E:
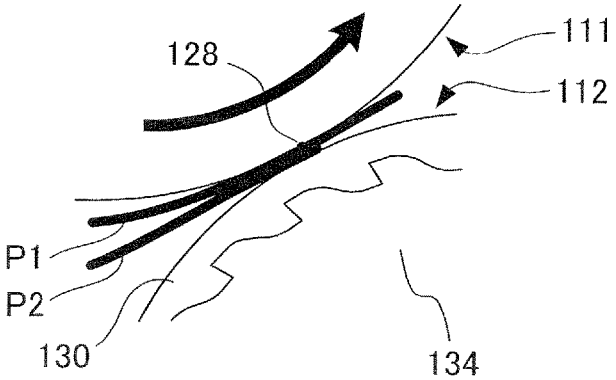
FIG. 9E is a diagram for describing a torque value of a torque limiter in the first exemplary embodiment.

The reason why the retard roller 112 rotates in the reverse direction or stops in the states of FIGS. 9C and 9D will be described with reference to FIG. 9E. FIG. 9E illustrates a state in which the flanges 134 do not affect the conveyance of the sheet P, that is, a state in which the retard roller 112 is not worn, to describe conditions for setting the maximum torque value that can be transmitted by the torque limiter 117. In addition, FIG. 9E illustrates a state in which two sheets P1 and P2 have entered the nip 128.

In the state of FIG. 9E in which the plurality of sheets P1 and P2 are present in the nip 128, to separate the sheet P1 from the sheet P2, it is required for the retard roller 112 to rotate in the reverse direction against the frictional force between the sheets or at least stop. In the case where the friction coefficient between the sheets is μs and the pressurizing force in the nip 128 is N, the magnitude of a frictional force that can be transmitted without slipping of the sheet P1 in contact with the feed roller 111 on the sheet P2 can be expressed as μs×N. Therefore, for the retard roller 112 to slide the sheet P2 on the sheet P1 and push back the sheet P2 in the direction opposite to the sheet feeding direction, a torque value T of the torque limiter 117 needs to be large enough to at least satisfy the following formula (4).

$$\mu s \times N \times r1 < T \quad (4)$$

In addition, the torque value T of the torque limiter 117 is set such that the retard roller 112 is allowed to rotate in such a manner as to follow the feed roller 111 in a state in which the sheet P is not present in the nip 128. That is, the following formula (5) holds.

$$T < \mu 1 \times N \times r1 \quad (5)$$

Here, the value of the friction coefficient μs between sheets is within a range of 0.6 to 0.8 in most cases. That is, the following relationship is satisfied between the friction coefficients μ1, μ2, and μs.

$$\mu 2 < \mu s < \mu 1 \quad (6)$$

From the formulae (4) to (6), it can be seen that the torque value T of the torque limiter 117 is set such that the following inequality is satisfied at least in the initial state.

$$\mu 2 \times N \times r1 < \mu s \times N \times r1 < T < \mu 1 \times N \times r1 \quad (7)$$

As can be seen from the formula (1), a force of F1×r1=μ1×N×r1 is applied to the retard roller 112 in the state of FIG. 9A. Therefore, it can be seen that, in this case, the retard roller 112 rotates in the following direction R1 overcoming the torque value T of the torque limiter 117.

Meanwhile, from the formula (3), it can be seen that a force of F3×r2=μ2×N×r2 is applied to the retard roller 112 in the state of FIG. 9C. Since r2 is smaller than r1 in the initial state, it can be seen from the formula (7) that this force is smaller than the torque value T of the torque limiter 117. Therefore, it can be seen that, in this case, the retard roller 112 rotates in the reverse direction following the torque transmitted from the torque limiter 117.

Actually, the force to rotate the retard roller 112 in the following direction R1 and the torque transmitted from the torque limiter 117 become balanced in the course of the leading end of the sheet advancing as from FIG. 9B to FIG. 9C. In such a state, the retard roller 112 stops rotating or shows a behavior of alternately repeating minute rotation in the reverse direction and minute rotation in the following direction. Then, as a result of the leading end of the sheet abutting the projecting portions 140 of the flanges 134 not rotating in the following direction, the conveyance of the sheet P is stopped as illustrated in FIG. 9D.

When a predetermined time passes after the leading end of the sheet is caught by the projecting portions 140, occurrence of a delay in the sheet feeding operation is detected, and the sheet feeding operation is stopped. Specifically, driving of the sheet feed motor M2 is stopped in the case where the leading end of the sheet is not detected by the conveyance sensor S1 illustrated in FIG. 3 in a predetermined time after driving of the sheet feed motor M2 is started. In this case, information prompting checking the wear state of the retard roller 112 and the like is notified by, for example, displaying a message on a user interface such as a liquid crystal display panel included in the image forming apparatus 1 or sending an e-mail to a management administrator. Then, an operator replaces the retard roller 112 on the basis of the notified information in a state in which the roller rubber 130 is not broken yet.

As described above, according to the present exemplary embodiment, the conveyance of the sheet automatically stops before the roller rubber 130 is extremely worn, that is, even when the sheet feed motor M2 is still driving, as a result of the effect of the projecting portions 140 of the flanges 134. That is, when the roller rubber 130 is worn by a predetermined amount or more, the conveyance of the sheet P is hindered by the projecting portions 140 of the flanges 134 as illustrated in FIGS. 9C and 9D. That is, the projecting portions 140 reduce the force applied from the feed roller 111 to the retard roller 112, and thus stops the rotation of the retard roller 112 following the feed roller 111. In parallel with this, the leading end of the sheet P abuts any one of the projecting portions 140, and thus the sheet P is prevented from passing through the nip 128 in the sheet feeding direction. As a result of this, a sheet feeding apparatus that is capable of preventing the breakage of the roller rubber 130 and thus has a high maintainability can be provided.

Configuration Example

A specific configuration example according to the present exemplary embodiment will be described. The roller rubber 130 constituting the outer circumferential portion of the separation roller generally has a tendency to wear more when the roller rubber 130 has higher performance of maintaining the friction coefficient. The outer diameter of the roller rubber 130 used in the present exemplary embodiment decreases by about 0.3 to 1.0 mm in the case where 100 thousand sheets have been fed, but the friction coefficient thereof does not decrease much. More specifically, an ethylene propylene diene monomer: EPDM rubber or a silicone rubber having a hardness of about 25 to 60 degrees as measured by a type-A durometer is preferable. The "hardness measured by type-A durometer" is a hardness known as JIS A hardness, and the details of the definition and measurement method of the hardness are based on JIS K 6254, which is a JIS standard corresponding to ISO 7619.

At least the flanges 134 of the roller core 131 are formed from a material that is less likely to wear than the roller rubber 130. For example, it is preferable that the flanges 134 are formed from a resin material harder than the roller rubber 130, which is formed from a rubber material. In addition, it is preferable that the flanges 134 and the core body 131*a* are integrally formed as a single member by a method such as injection molding. As the resin material, polyacetal: POM having a hardness of about 99 degrees as measured by the type-A durometer can be used. In addition, setting the friction coefficient of the flanges 134 against a sheet of a material normally used for a recording medium to be smaller than the friction coefficient of the roller rubber 130 against the sheet is also effective for suppressing the wear of the flanges 134 as compared with the roller rubber 130. For example, friction coefficients against printing paper not having undergone surface treatment may be compared.

Whether or not the flanges 134 are less likely to wear than the roller rubber 130 can be confirmed by conducting an abrasion test on a sheet by using a test piece of the same material as the flanges 134 or the roller rubber 130. As a test apparatus, known abrasion wear testers such as a pin-on-disk system can be used. A sheet of a material normally used is stuck on a support member and the test piece is rubbed on a rubbing surface that comes into contact with the test piece in conditions close to the use conditions of a product. The conditions include contact pressure, temperature, and humidity. Then, by measuring a change in the volume of the test piece after rubbing operation of a certain amount, the abrasion resistance of the flanges 134 and the roller rubber 130 can be evaluated.

For the recess/projection shape of the flanges 134, a shape having a pitch in the circumferential direction of about 0.5 mm to 3 mm is preferable. To be noted, the pitch of the recess/projection shape is an interval between the plurality of projecting portions 140 that are periodically formed, and corresponds to a distance p1 between end points on the outside in radial directions, in which the respective projecting portions 140 project, of the projecting portions 140 adjacent in the circumferential direction in FIG. 10. Regarding the recess/projection shape, the height of the projections has to be smaller when the pitch is smaller, to ensure a certain degree of strength. Therefore, in the case where the pitch is too small, the height of the projections becomes insufficient, and the sheet is less likely to be caught in the state in which the roller rubber 130 has been worn. In contrast, in the case where the pitch is too large, sometimes the projecting portions 140 do not project to the vicinity of the nip 128 depending on the rotational phase of the retard roller 112 in the state in which the roller rubber 130 is worn. In this case, there is a risk that the leading end of the sheet passes through the nip 128 without getting caught by the projecting portions 140, and the wear of the roller rubber 130 further progresses to cause breakage.

Figure 10:
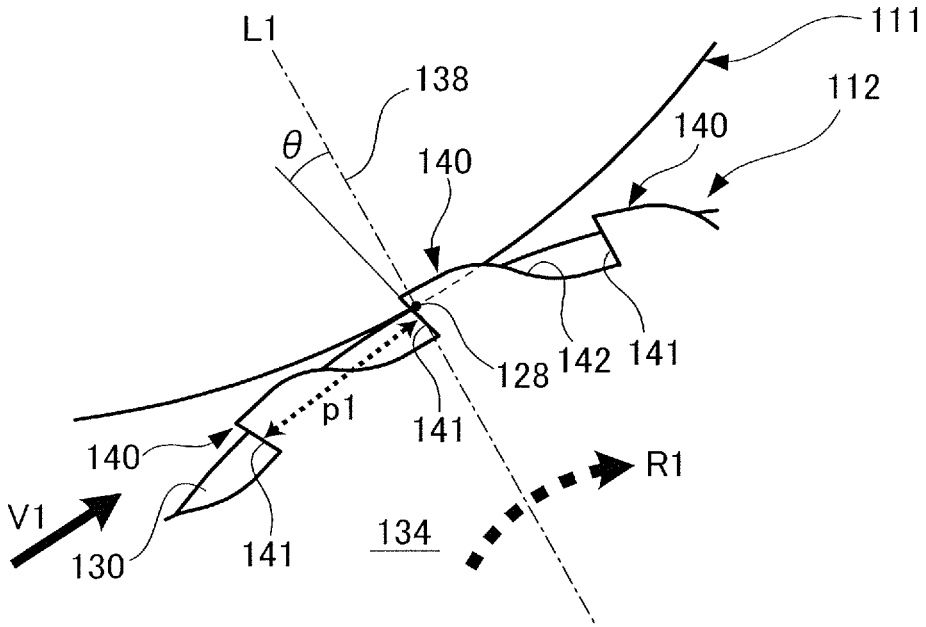
FIG. 10 is a diagram illustrating a recess/projection shape provided on a flange of a roller core according to the first exemplary embodiment.

In addition, it is preferable that the recess/projection shape of the flanges 134 includes a surface 141 that extends more upstream in the following direction R1 at a position further on the outside in a radial direction on a side portion of each of the projecting portions 140 on the upstream side in the following direction R1 to catch the leading end of the sheet as illustrated in FIG. 10. This surface 141 is a first surface in the present exemplary embodiment. The surface 141 is inclined by an angle θ with respect to a straight line L1 connecting rotation centers of the retard roller 112 and the feed roller 111 in the case where the surface 141 is on the straight line L1, that is, at such a position as to cross the straight line L1, as viewed in the axial direction of the retard roller 112. The direction of the inclination in this case is a direction in which the surface 141 extends more upstream in the sheet feeding direction V1 at a position further on the outside in the radial direction of the retard roller 112 with respect to the straight line L1 passing through the nip 128. According to such a configuration, the leading end of the sheet abutting the surface 141 receives a force toward the inside in the radial direction from the surface 141, and thus a possibility that the leading end of the sheet that has been caught by the projecting portions 140 is disengaged outwardly in the radial direction of the projecting portions 140 can be reduced. The value of the angle θ is preferably set to 0 degree or larger, and more preferably to 5 to 30 degrees.

On the downstream side of the projecting portion 140 in the following direction R1, a surface 142 serving as a second surface is provided. The surface 142 extends from an outer end of a certain surface 141 in the radial direction toward an inner end of another surface 141 in the radial direction. The other surface 141 is adjacent to the certain surface 141 and is on the downstream side of the certain surface 141 in the following direction RI. By employing such a shape that the outer diameter of the surface 142 continuously decreases toward the downstream side in the following direction R1, the possibility of the leading end of the sheet getting caught by the surface 141 serving as a first surface can be increased.

Next, the relationship between the recess/projection shape of the flanges 134 and a pressurizing configuration of the retard roller 112 will be described. In the present exemplary embodiment, the retard roller 112 is movably supported by the bearing portion 129 serving as a support member with respect to the apparatus body, and is urged toward the feed roller 111 by the retard spring 118. The bearing portion 129 is supported so as to be capable of moving by about several millimeters in a direction approaching the feed roller 111 from a position in which the retard roller 112 abuts the feed roller 111 in a state in which the roller rubber 130 is not worn.

This amount by which the retard roller 112 is capable of moving in the urging direction of the retard spring 118 from the position of the initial state is set to be larger than the thickness of the roller rubber 130 of the initial state. This amount will be hereinafter referred to as a pressurizing stroke. The thickness of the roller rubber 130 of the initial state is defined by the difference between the outer diameter of the outer circumferential surface 131*b* of the core body 131*a* and the outer diameter of the roller rubber 130. This is to use the roller rubber 130 more efficiently. That is, regarding only the effect of "automatically stopping feeding of a sheet before the roller rubber breaks" obtained by the configuration of this proposal, this effect can be also realized by a configuration in which "the pressurizing stroke is smaller than the thickness of the roller rubber 130". However, according to such a configuration, as the wear of the retard roller 112 progresses, the feed roller 111 and the retard roller 112 will be eventually separated, and the nip 128 will be no longer formed. In this state, the feed roller 111 and the retard roller 112 cannot nip the sheet, thus the frictional force from the feed roller 111 is not applied to the sheet, and the sheet cannot be fed.

In contrast, in the present exemplary embodiment, a configuration in which "the pressurizing stroke is larger than the thickness of the roller rubber 130" is employed. In other words, in this configuration, the rotation axis of the retard roller 112 is capable of moving to a position closer to the feed roller 111 by at least the thickness of the roller rubber 130 from the position of the initial state in which the roller rubber 130 is not worn. Therefore, the roller rubber 130 of the retard roller 112 is still in pressure contact with the feed roller 111 even in a state in which the outer diameter of the roller rubber 130 has become smaller than the outer diameter of the flanges 134. Therefore, even after the wear of the roller rubber 130 has progressed to a certain degree, a state in which the sheet can be fed is maintained at least until the conveyance of the sheet is hindered by the flanges 134, and thus the lifetime of the sheet feeding apparatus can be improved.

To be noted, the pressurizing stroke can involve an error of several millimeters at most with respect to a design value due to variation in part dimensions occurring in the manufacturing process. Therefore, depending on the variation in the part dimensions, there is a risk that the feeding of the sheet stops even when enough thickness of the roller rubber 130 still remains. In contrast, in the present exemplary embodiment, the feeding of the sheet can be automatically stopped as an effect of the retard roller 112 when the wear of the roller rubber 130 progresses, and therefore the pressurizing stroke can be set to a value sufficiently larger than the thickness of the roller rubber 130. As a result of this, the variation in the actual pressurizing stroke affecting whether or not the sheet is normally fed can be avoided, and the roller rubber 130 can be used up efficiently.

From the above-described viewpoint of using up the roller rubber 130 efficiently, it is preferable that a configuration in which the flanges 134 start contacting the sheet when the thickness of the roller rubber 130 reaches a predetermined thickness set within a range from 0.5 mm to 1.5 mm is employed. This can be realized by, for example, setting the outer diameter of the flanges 134 to be larger than the inner diameter of the roller rubber 130 (that is, the outer diameter of the outer circumferential surface 131*b* of the core body 131*a*) by a difference of 1 mm to 3 mm. In the case where the difference between the outer diameter of the flanges 134 and the inner diameter of the roller rubber 130 is too small, there is a risk that the roller rubber 130 that has become thin cannot hold against the load generated in the nip 128 and breaks before the feeding of the sheet is stopped by the flanges 134. Meanwhile, in the case where the difference between the outer diameter of the flanges 134 and the inner diameter of the roller rubber 130 is too large, the feeding of the sheet is stopped by the flanges 134 even when the thickness is still larger than the minimum thickness to avoid the breakage by a good margin. As a result of this, replacement of the retard roller 112 is requested more frequently than needed for the actual lifetime of the roller rubber 130, which leads to decrease in the usability of the sheet feeding apparatus.

The lifetime of the retard roller 112 in the present exemplary embodiment is defined as a period until the feeding of the sheet is stopped by the flanges 134 as a result of the roller rubber 130 being worn by a predetermined amount from the thickness of the initial state. The thickness of the initial state can be changed as appropriate. For example, the thickness of the initial state is preferably set to about 2 mm.

Second Exemplary Embodiment

Next, a sheet feeding apparatus according to a second exemplary embodiment will be described with reference to FIGS. 11A to 12B. In the present exemplary embodiment, the relationship between the lengths in the axial direction (i.e., roller widths) of the feed roller 111 and a retard roller 112B is different from that of the first exemplary embodiment. Hereinafter, elements substantially the same as in the first exemplary embodiment will be denoted by the same reference signs as in the first exemplary embodiment, and descriptions thereof will be omitted.

Figure 11A:
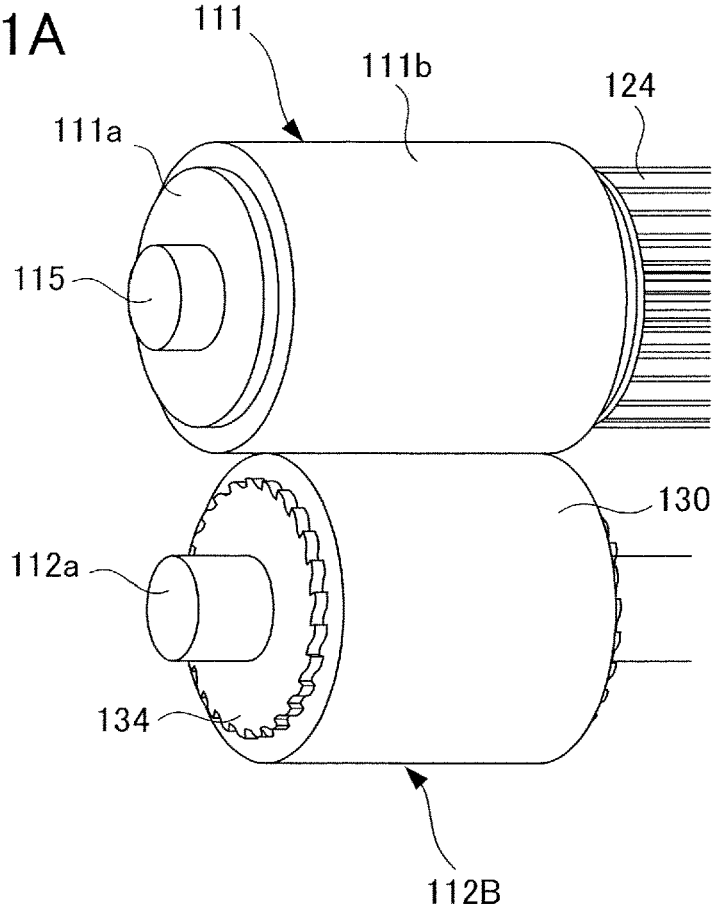
FIG. 11A is a perspective view of a retard roller and a feed roller in an initial state in a second exemplary embodiment.
Figure 11B:
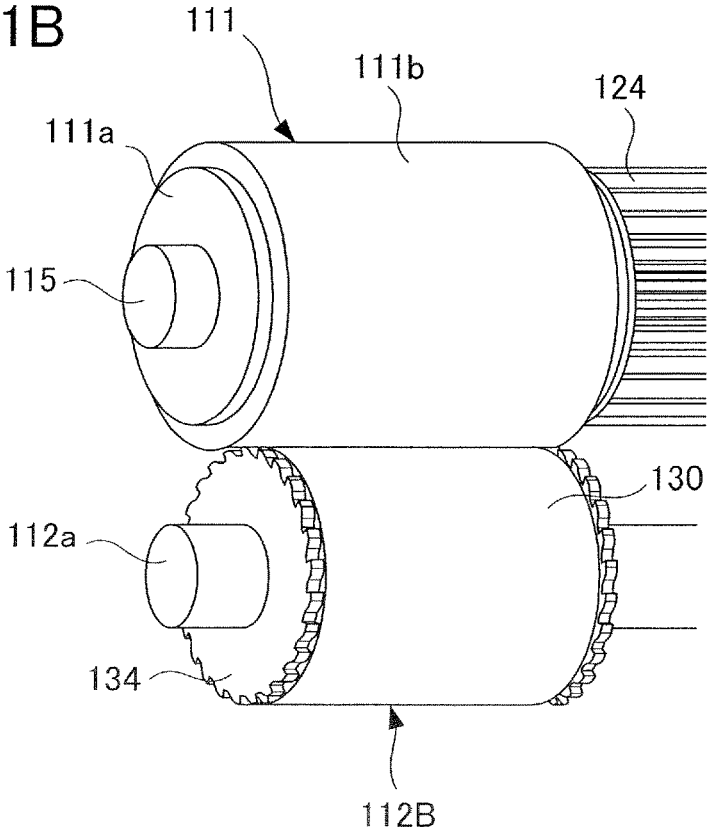
FIG. 11B is a perspective view of the retard roller and the feed roller in a state in which the roller rubber has been worn in the second exemplary embodiment.

In the first exemplary embodiment, the roller width of the retard roller 112 is equal to the roller width of the feed roller 111, and therefore the flanges 134 do not abut the feed roller 111. In the present exemplary embodiment, the roller width of the retard roller 112B is set to be smaller than the roller width of the feed roller 111. That is, the length of the roller rubber 130 constituting the outer circumferential portion of the retard roller 112B in the axial direction is set to be smaller than the length of the roller rubber 111*b* constituting the outer circumferential portion of the feed roller 111 in the axial direction. Further, the flanges 134 of the retard roller 112B are disposed on both ends of the roller rubber 130 within a range in which the roller rubber 111*b* of the feed roller 111 is provided in the axial direction. Therefore, the flanges 134 directly contact the feed roller 111 in a state in which the roller rubber 130 of the retard roller 112B has been worn as illustrated in FIG. 11B.

As described in the first exemplary embodiment, in the case where the feeding of the sheet is repeated in the state in which the sheet comes into contact with both of the surface of the roller rubber 130 and the flanges 134, the wear of the roller rubber 130 progresses much faster than the wear of the flanges 134 due to the difference in materials thereof. Therefore, also in the present exemplary embodiment, the outer diameter of the roller rubber 130 gradually becomes smaller with respect to the outer diameter of the flanges 134. As a result of progress in such a change, the pressurizing force that has initially acted in the nip 128 between the feed roller 111 and the retard roller 112B starts dissipating to a contact portion between the feed roller 111 and the flanges 134. That is, accompanied by the wear of the roller rubber 130, at least part of the urging force of the retard spring 118 starts acting as a force pressing the feed roller 111, and the contact pressure in the nip 128 decreases by an amount corresponding to this.

Here, the flanges 134 are configured such that the value of the friction coefficient between the feed roller 111 and the flanges 134 is smaller than the value of the friction coefficient between the feed roller 111 and the retard roller 112B. Therefore, as illustrated in FIG. 11B, the force in the following direction transmitted from the feed roller 111 to the retard roller 112B becomes smaller as the wear of the roller rubber 130 of the retard roller 112B progresses.

Figure 12A:
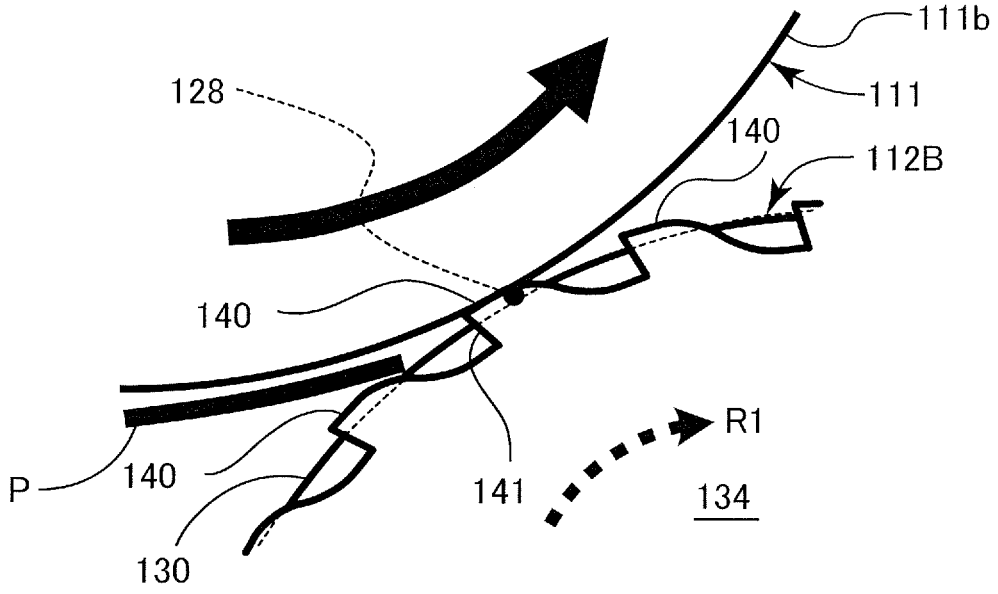
FIG. 12A is a diagram for describing an operation in the case where feeding of a sheet is started in the state in which the roller rubber has been worn in the second exemplary embodiment.
Figure 12B:
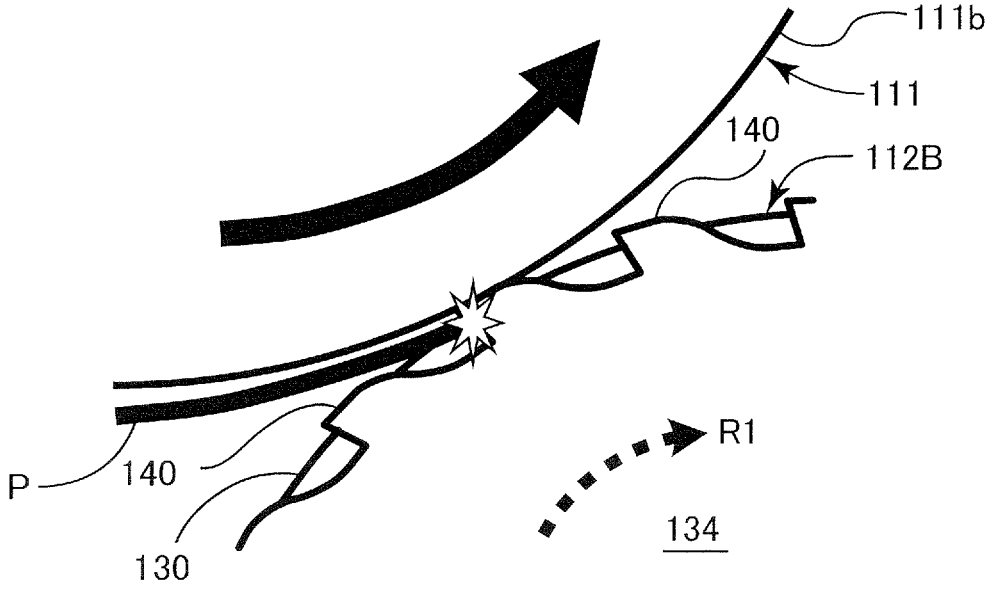
FIG. 12B is another diagram for describing the operation in the second exemplary embodiment.

An operation performed in the case where the feeding of the sheet is started in the state of FIG. 11B will be described with reference to FIGS. 12A and 12B. FIGS. 12A and 12B are each a schematic diagram illustrating the vicinity of the nip 128 as viewed in the axial direction. After the sheet feeding operation is started, the pickup roller 110 and the feed roller 111 start rotating. The sheet P first receives the force from the pickup roller 110, and moves toward the nip 128 as illustrated in FIG. 12A.

At this time, since the feed roller 111 and the flanges 134 are in contact with each other, the retard roller 112B cannot receive sufficient force from the feed roller 111, and therefore the retard roller 112B is at least not rotating in the following direction R1. That is, in the present exemplary embodiment, the rotation in the following direction R1 is not performed as a result of the flanges 134 slipping with respect to the feed roller 111 before the flanges 134 come into contact with the sheet P.

In the case where the leading end of the sheet P enters the nip 128 in this state, the leading end of the sheet P is caught by any one of the projecting portions 140 of the flanges 134, and the conveyance of the sheet P is hindered. That is, on the premise that the projecting portions 140 of the same shape as in the first exemplary embodiment are provided, the leading end of the sheet P abuts the surface 141 of a projecting portion 140 on the upstream side in the sheet feeding direction, and thus the sheet P is prevented from passing through the separation nip 128 in the sheet feeding direction. Then, the retard roller 112B will be replaced in accordance with the notification of occurrence of a delay, and therefore the retard roller 112B is expected to be replaced before the possibility of breakage of the roller rubber 130 increases.

As described above, the configuration of stopping the feeding of the sheet before the roller rubber 130 is extremely worn can be realized by the effect of the flanges 134 even in the case where the roller width of the retard roller 112B is smaller than the roller width of the feed roller 111. As a result of this, occurrence of inconvenience caused by the breakage of the roller rubber 130 can be avoided, and thus a sheet feeding apparatus having high maintainability can be provided.

As described in the first exemplary embodiment and the present exemplary embodiment, such an advantage can be obtained regardless of whether or not the flanges 134 come into contact with the feed roller 111 in the state in which the roller rubber 130 has been worn. That is, the roller width of the retard roller may be larger than the roller width of the feed roller 111 conversely to the second exemplary embodiment, or a configuration in which these rollers have the same width and are displaced from each other in the axial direction may be employed. In addition, a configuration in which the flange 134 having the recess/projection shape is disposed on only one side in the axial direction of the roller rubber 130 may be employed.

In the present exemplary embodiment, description has been given on the premise that the flanges 134 come into contact with the roller rubber 111*b* of the feed roller 111 in a state in which the roller rubber 130 of the retard roller 112B has been worn. However, for example, portions opposing the flanges 134 of the feed roller 111 may be formed from a resin material, and the flanges 134 may be configured to slip on these resin portions. That is, an effect similar to that of the present exemplary embodiment can be expected as long as the flanges 134 come into contact with part of the feed roller 111 as the wear of the roller rubber 130 progresses and the friction coefficient between the flanges 134 and a contact portion of the feed roller 111 is smaller than the friction coefficient between roller rubbers.

Modification Example of Recess/Projection Shape

Figure 13A:
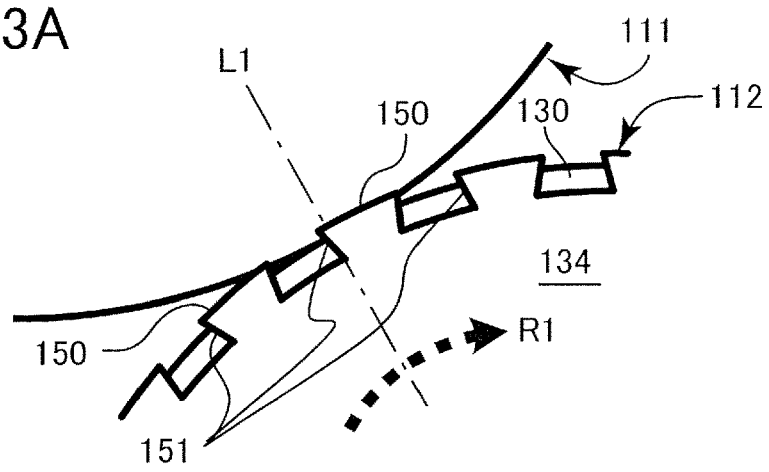
FIGS. 13A to 13C are diagrams illustrating modification examples of a recess/projection shape of a flange.
Figure 13B:
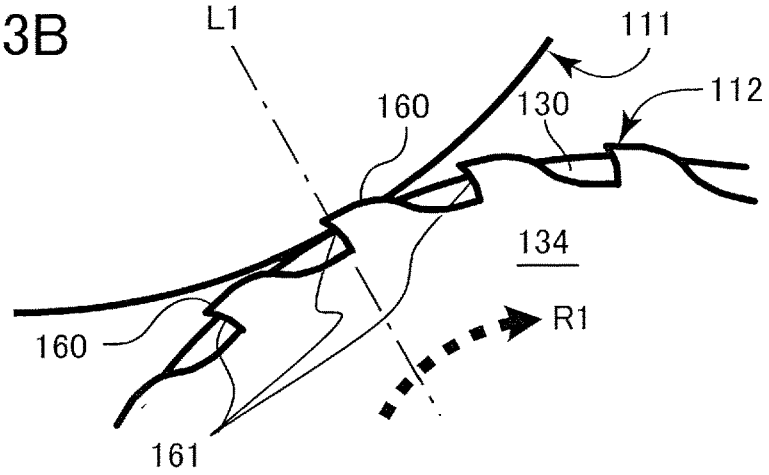
Figure 13C:
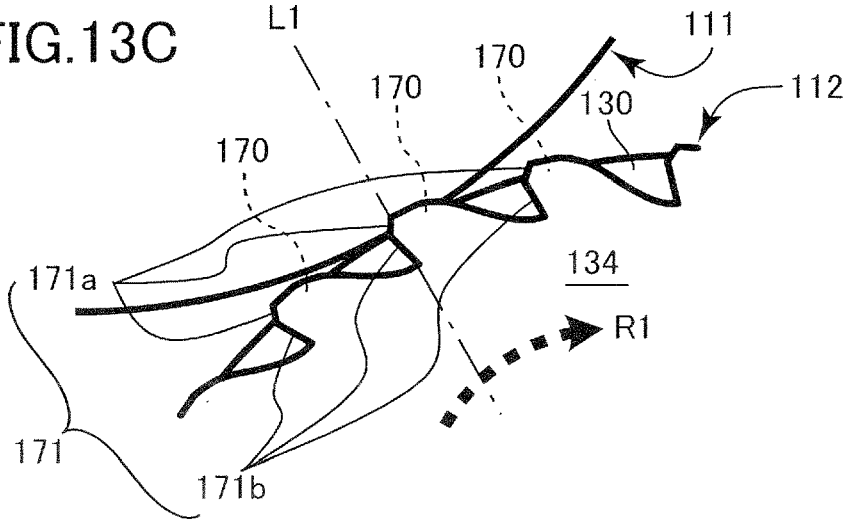

Although a configuration example in which the flanges 134 serving as flange portions have the same recess/projection shape has been described in the first and second exemplary embodiments described above, different recess/projection shapes may be used. FIGS. 13A to 13C are each a schematic diagram for illustrating a modification example of the recess/projection portion, and illustrates the vicinity of the nip 128 as viewed in the axial direction.

FIG. 13A illustrates an example in which projecting portions 150 are each not anisotropic in terms of the circumferential direction. FIG. 13B illustrates an example in which surfaces 161 of projecting portions 160 on the upstream side in the following direction R1 are curved surfaces. In these examples, surfaces 151 and 161 of the projecting portions 150 and 160 on the upstream side in the following direction R1 extend more upstream in the following direction R1 at positions further on the outside in the radial direction of the retard roller 112. That is, as viewed in the axial direction, the surfaces 151 and 161 have such a shape that a surface 151 or 161 at such a position as to cross the straight line L1 connecting the rotation axes of the retard roller 112 and the feed roller 111 is inclined with respect to the straight line L1 such that a portion thereof further on the outside in the radial direction of the retard roller 112 extends more upstream in the sheet feeding direction. Even in the case where such a shape is employed, the surfaces 151 and 161 act as the first surface that catches the leading end of the sheet similarly to the surface 141 of the first and second exemplary embodiments.

FIG. 13C illustrates an example in which a side portion 171 of each of projecting portions 170 on the upstream side in the following direction R1 is constituted by two surfaces 171*a* and 171*b* extending in different directions. The surface 171*b* further on the inside in the radial direction extends more upstream in the following direction R1 at a position further on the outside in the radial direction of the retard roller 112. The surface 171*a* further on the outside in the radial direction extends more downstream in the following direction R1 at a position further on the outside in the radial direction of the retard roller 112. That is, the surface 171*b* serving as a first surface is provided in only a part of an upstream side portion of the projecting portion 170 in the following direction R1.

In the case where this recess/projection shape is employed, the effect of the surface 171*a* to catch the leading end of the sheet is weak, and there is the possibility that only the surface 171*a* catches the leading end of the sheet in a state in which only the surface 171*a* projects further to the outside in the radial direction than the roller rubber 130. However, when the wear of the roller rubber 130 further progresses, the surface 171*b* starts projecting further to the outside in the radial direction than the roller rubber 130, and thus the feeding of the sheet can be automatically stopped by catching the leading end of the sheet by the surface 171*b*. Therefore, the retard roller 112 can be replaced before occurrence of the breakage of the roller rubber 130 also according to this configuration.

Other Embodiments

In addition to the first and second exemplary embodiments and modification examples thereof described above, various modifications can be made within the technical concept represented by the exemplary embodiments described above.

For example, a separation roller coupled to, via a torque limiter, a shaft member fixed to the apparatus body may be used instead of the retard roller 112 described above to which a driving force in the reverse direction is input from a drive source. This separation roller separates one sheet from sheets by a frictional force in a nip portion formed between the separation roller and a rotary feeding member such as the feed roller 111. Further, by providing such a separation roller with such a flange portion as described in the exemplary embodiments, it becomes possible to catch the sheet by the recess/projection shape of the flange portion to automatically stop feeding of the sheet when the elastic member constituting the outer circumferential portion of the separation roller has been worn. In addition, although the flanges 134 and the core body 131*a* are integrally formed as a single body in the exemplary embodiments described above, these may be formed from different materials.

In addition, the feed roller 111 is an example of a rotary feeding member, and, for example, a configuration in which the sheet is fed by a belt member rotating along the sheet feeding direction may be employed. In this case, the separation of a sheet is performed by disposing the retard roller 112 to oppose the belt member. In addition, a configuration in which the feed roller 111 abuts the sheet supported on the sheet supporting portion to start feeding may be employed instead of the configuration in which the feed roller 111 receives and conveys a sheet fed out from a support portion such as an inner plate by the pickup roller 110.

In addition, the sheet feeding portion 30 of a cassette type is an example of a sheet feeding apparatus, and, for example, this technique may be applied to an automatic feed apparatus that automatically feeds a document in the manual sheet feed portion 250 illustrated in FIG. 1 or the image reading apparatus 202.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-036884, filed on Mar. 1, 2018, which is hereby incorporated by reference herein in its entirety.

What is claimed is:

1. A sheet feeding apparatus comprising:

a sheet supporting portion configured to support a sheet;

a rotary feeding member configured to feed the sheet supported on the sheet supporting portion; and a separation roller disposed to oppose the rotary feeding member and configured to separate one sheet fed by the rotary feeding member from another sheet in a nip portion formed between the separation roller and the rotary feeding member, wherein the separation roller comprises:

an outer circumferential portion formed from an elastic material in a tubular shape and configured to come into contact with the sheet in the nip portion;

a core portion to which the outer circumferential portion is attached; and a flange portion comprising a plurality of projecting portions provided at a plurality of positions in a circumferential direction and each projecting to an outside in a radial direction with respect to the core portion, the flange portion being disposed outside of the outer circumferential portion in an axial direction of the separation roller, wherein an outer diameter of the outer circumferential portion is larger than an outer diameter of the flange portion, and wherein at least one of the plurality of projecting portions comprises a first surface provided on a side portion thereof on an upstream side in a first direction, the first direction being a rotation direction in which the separation roller rotates in such a manner as to follow the rotary feeding member rotating to feed the sheet, the first surface extending more upstream in the first direction at a position further on an outside in a radial direction with respect to a rotation axis of the separation roller as viewed in the axial direction.

2. The sheet feeding apparatus according to claim 1, wherein, as viewed in the axial direction, in a state in which the first surface is positioned on a straight line drawn from the rotation axis of the separation roller toward the nip portion, an angle formed between the first surface and the straight line is 5 to 30 degrees.

3. The sheet feeding apparatus according to claim 1, wherein each of the plurality of projecting portions comprises the first surface.

4. The sheet feeding apparatus according to claim 1, wherein the projecting portion comprising the first surface among the plurality of projecting portions further comprises a second surface provided on a side portion thereof on a downstream side in the first direction, the second surface extending from an outer end of the projecting portion in a radial direction toward the downstream side in the first direction and toward an inner end of the first surface of another one among the plurality of projecting portions in the radial direction, the other one among the plurality of projecting portions being positioned downstream of and adjacent to the projecting portion comprising the first surface and the second surface in the first direction, and wherein the second surface is formed such that a distance from the second surface to the rotation axis of the separation roller continuously decreases toward a downstream side in the first direction.

5. The sheet feeding apparatus according to claim 1, wherein the plurality of projecting portions are periodically provided in a pitch of 0.5 mm to 3 mm in the circumferential direction.

6. The sheet feeding apparatus according to claim 1, wherein the outer circumferential portion of the separation roller is formed from a rubber material, and wherein the flange portion is formed from a resin material harder than the rubber material.

7. The sheet feeding apparatus according to claim 1, wherein the outer diameter of the flange portion is larger than the outer diameter of the core portion by a difference of 1 mm to 3 mm.

8. The sheet feeding apparatus according to claim 1, wherein the outer circumferential portion and the flange portion are formed such that a hardness of the outer circumferential portion measured by a type-A durometer is smaller than a hardness of the flange portion measured by the type-A durometer.

9. The sheet feeding apparatus according to claim 1, wherein the core portion and the flange portion are integrally formed as a single member from a resin material.

10. The sheet feeding apparatus according to claim 1, wherein the flange portion is disposed outside a range where an outer circumferential surface of the rotary feeding member is disposed in the axial direction, and wherein the separation roller is configured such that, in a state in which the outer diameter of the outer circumferential portion has become smaller than the outer diameter of the flange portion, even if only one sheet enters the nip portion, the flange portion comes into contact with the only one sheet and thus the separation roller does not rotate in the first direction.

11. The sheet feeding apparatus according to claim 1, wherein the flange portion is disposed inside a range in which an outer circumferential surface of the rotary feeding member is disposed in the axial direction, and wherein the separation roller is configured such that, in a state in which the outer diameter of the outer circumferential portion has become smaller than the outer diameter of the flange portion, in a case where no sheet is present in the nip portion, the flange portion comes into contact with and slips on the rotary feeding member and thus the separation roller does not rotate in the first direction.

12. The sheet feeding apparatus according to claim 1, further comprising:

a drive source configured to drive the separation roller in a second direction opposite to the first direction; and a torque limiter provided in a drive transmission path from the drive source to the separation roller and configured to transmit a driving force to the separation roller and allow the separation roller to rotate in such a manner as to follow the rotary feeding member in a case where a torque larger than a predetermined value is applied from the rotary feeding member to the separation roller.

13. The sheet feeding apparatus according to claim 1, further comprising:

an urging member configured to urge the separation roller toward the rotary feeding member; and a support member configured to rotatably support the separation roller, wherein the support member supports the separation roller such that the rotation axis of the separation roller is capable of moving from a position, at which the separation roller is in contact with the rotary feeding member in a state in which the outer circumferential portion is not worn, to a position closer to the rotary feeding member by at least a thickness of the outer circumferential portion.

14. An image forming apparatus comprising:

the sheet feeding apparatus according to claim 1; and an image forming portion configured to form an image on the sheet fed by the sheet feeding apparatus.

15. A sheet feeding apparatus comprising:

a sheet supporting portion configured to support a sheet;

a rotary feeding member configured to feed the sheet supported on the sheet supporting portion; and a separation roller disposed to oppose the rotary feeding member and configured to separate one sheet fed by the rotary feeding member from another sheet in a nip portion formed between the separation roller and the rotary feeding member, wherein the separation roller comprises:

an outer circumferential portion formed from an elastic material in a tubular shape and configured to come into contact with the sheet in the nip portion;

a core portion configured to support an inner circumferential surface of the outer circumferential portion; and a flange portion comprising a plurality of projecting portions provided at a plurality of positions in a circumferential direction and each projecting to an outside in a radial direction with respect to the core portion, wherein, in a state in which the outer circumferential portion is not worn, an outer diameter of the outer circumferential portion is larger than an outer diameter of the flange portion, and wherein the plurality of projecting portions are configured such that, in a state in which the outer diameter of the outer circumferential portion has become smaller than the outer diameter of the flange portion, conveyance of the sheet by the rotary feeding member is hindered by any one of the plurality of projecting portions abutting a leading end of the sheet in a sheet feeding direction of the rotary feeding member.

16. The sheet feeding apparatus according to claim 15, wherein each of the plurality of projecting portions comprises a first surface provided on a side portion on an upstream side thereof in a first direction, the first direction being a rotation direction in which the separation roller rotates in such a manner as to follow the rotary feeding member rotating to feed the sheet, the first surface being configured to abut the leading end of the sheet in the sheet feeding direction in the state in which the outer diameter of the outer circumferential portion has become smaller than the outer diameter of the flange portion.

17. An image forming apparatus comprising:

the sheet feeding apparatus according to claim 15; and an image forming portion configured to form an image on the sheet fed by the sheet feeding apparatus.

18. A separation roller for a sheet feeding apparatus, the separation roller comprising:

an outer circumferential portion formed from an elastic material in a tubular shape and configured to come into contact with a sheet in a nip portion between the separation roller and a rotary feeding member of the sheet feeding apparatus;

a core portion to which the outer circumferential portion is attached; and a flange portion comprising a plurality of projecting portions provided at a plurality of positions in a circumferential direction and each projecting to an outside in a radial direction with respect to the core portion, the flange portion being disposed outside of the outer circumferential portion in an axial direction of the separation roller, wherein an outer diameter of the outer circumferential portion is larger than an outer diameter of the flange portion, and wherein at least one of the plurality of projecting portions comprises a first surface provided on a side portion thereof on an upstream side in a first direction, the first direction being a rotation direction in which the separation roller rotates in such a manner as to follow the rotary feeding member rotating to feed the sheet, the first surface extending more upstream in the first direction at a position further on an outside in a radial direction with respect to a rotation axis of the separation roller as viewed in the axial direction.

19. The separation roller according to claim 18, wherein, as viewed in the axial direction, in a state in which the first surface is positioned on a straight line drawn from the rotation axis of the separation roller toward the nip portion, an angle formed between the first surface and the straight line is 5 to 30 degrees.

20. A separation roller for a sheet feeding apparatus, the separation roller comprising:

an outer circumferential portion formed from an elastic material in a tubular shape and configured to come into contact with a sheet in a nip portion between the separation roller and a rotary feeding member of the sheet feeding apparatus;

a core portion configured to support an inner circumferential surface of the outer circumferential portion; and a flange portion comprising a plurality of projecting portions provided at a plurality of positions in a circumferential direction and each projecting to an outside in a radial direction with respect to the core portion, wherein, in a state in which the outer circumferential portion is not worn, an outer diameter of the outer circumferential portion is larger than an outer diameter of the flange portion, and wherein the plurality of projecting portions are configured such that, in a state in which the outer diameter of the outer circumferential portion has become smaller than the outer diameter of the flange portion, conveyance of the sheet by the rotary feeding member is hindered by any one of the plurality of projecting portions abutting a leading end of the sheet in a sheet feeding direction of the rotary feeding member.

* * * * *